US009933749B2

(12) United States Patent
Shimizu et al.

(10) Patent No.: US 9,933,749 B2
(45) Date of Patent: Apr. 3, 2018

(54) GEAR CONFIGURATION FOR A DEVELOPING CARTRIDGE

(71) Applicant: Brother Kogyo Kabushiki Kaisha, Nagoya-shi, Aichi-ken (JP)

(72) Inventors: Keita Shimizu, Nagoya (JP); Tomoya Yamamoto, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/459,966

(22) Filed: Mar. 15, 2017

(65) Prior Publication Data

US 2017/0285560 A1 Oct. 5, 2017

(30) Foreign Application Priority Data

Mar. 31, 2016 (JP) ..... 2016-072186

(51) Int. Cl.
*G03G 15/00* (2006.01)
*G03G 15/08* (2006.01)
*G03G 21/16* (2006.01)

(52) U.S. Cl.
CPC ..... *G03G 21/1647* (2013.01); *G03G 15/0865* (2013.01)

(58) Field of Classification Search
CPC ..... G03G 15/0865; G03G 21/1647; G03G 21/1676; G03G 21/1857; G03G 2221/163; G03G 2221/1657
See application file for complete search history.

(56) References Cited

U.S. PATENT DOCUMENTS 7,965,962 B2 6/2011 Mori
2008/0193154 A1* 8/2008 Yamada ..... G03G 15/0865 399/27
2008/0317509 A1 12/2008 Mori
2017/0097588 A1* 4/2017 Fukamachi ..... G03G 15/0889

FOREIGN PATENT DOCUMENTS

JP S53-119945 U 9/1978
JP S58-220158 A 12/1983
JP S62-081678 A 4/1987
JP H04-240875 A 8/1992
JP H05-072898 A 3/1993
JP H06-250519 A 9/1994
(Continued)

*Primary Examiner* — Sophia S Chen
(74) *Attorney, Agent, or Firm* — Banner & Witcoff, Ltd.

(57) ABSTRACT

A developer cartridge may include a gear configured to be movable between an engagement position in which the gear engages an auger or supply gear to provide toner from a toner container to a developing unit and a disengaged position in which the gear does not engage the auger or supply gear. The gear may be moved by a cam and/or cam gear from the engagement position to the disengaged position and vice versa. The cam gear may include toothless and toothed portions to allow the developer cartridge to maintain the movable gear in either the engagement position or the disengaged position. In some arrangements, an urging member such as a spring may bias the cam gear in a rotation direction, while a lever may provide a counteracting force when the movable gear is to be maintained in a particular position.

30 Claims, 20 Drawing Sheets

(56) References Cited

FOREIGN PATENT DOCUMENTS

| | | | |
|---|---|---|---|
| JP | 2005-003796 | A | 1/2005 |
| JP | 2006-194913 | A | 7/2006 |
| JP | 2007-079167 | A | 3/2007 |
| JP | 2007-310134 | A | 11/2007 |
| JP | 2009-003375 | A | 1/2009 |

* cited by examiner

GEAR CONFIGURATION FOR A DEVELOPING CARTRIDGE

CROSS-REFERENCE TO RELATED APPLICATION

This application claims priority from Japanese Patent Application No. 2016-072186 filed on Mar. 31, 2016, the content of which is incorporated herein by reference in its entirety.

FIELD OF DISCLOSURE

The disclosure relates to a developing cartridge including a developing roller.

BACKGROUND

A known image forming apparatus includes a developing chamber and a buffer. The developing chamber includes a developing sleeve. The buffer contains developer to be supplied to the developing chamber. The buffer includes an agitator member that is rotated to supply the developer to the developing chamber. The buffer also includes an agitator gear for rotating the agitator member. The agitator gear is rotated by drive force from a drive unit. The drive unit includes a pendulum gear configured to contact, e.g., engage, and be separated, e.g., disengage, from the agitator gear by forward and reverse rotation of a gear in the drive unit.

A known process unit includes a process frame and a toner box. The process frame includes a developing unit including a developing roller. The toner box is configured to be attached and removed relative to the process frame. The process frame further includes a coupling gear and a drive gear. The drive gear rotates by receiving drive force from the coupling gear, and transmits the drive force to a transmission gear of the toner box. The toner box includes an agitator. The agitator rotates by receiving the drive force from the transmission gear. As the agitator rotates, the developer in the toner box is supplied to the developing roller in the process frame.

SUMMARY

In some arrangements, by applying the drive unit of the image forming apparatus to the process unit, the drive gear is brought into and out of contact with the transmission gear.

In such a configuration, if a mechanism for forwardly and reversely rotating the gear of the drive unit is provided to a gear mechanism of the process unit, the coupling gear needs to be forwardly and reversely rotated to move the drive gear. Because the developing roller is coupled to the coupling gear, forward or reverse rotation of the coupling gear causes the developing roller to reversely rotate, which may lead to toner leakage out of the process unit.

One or more aspects of the disclosure provide a developing cartridge, including a movable gear, in which the gear is selectively moved using drive force of a coupling.

DETAILED DESCRIPTION

An illustrative embodiment and modifications according to one or more aspects of the disclosure are described in detail with reference to the accompanying drawings.

Figure 1:
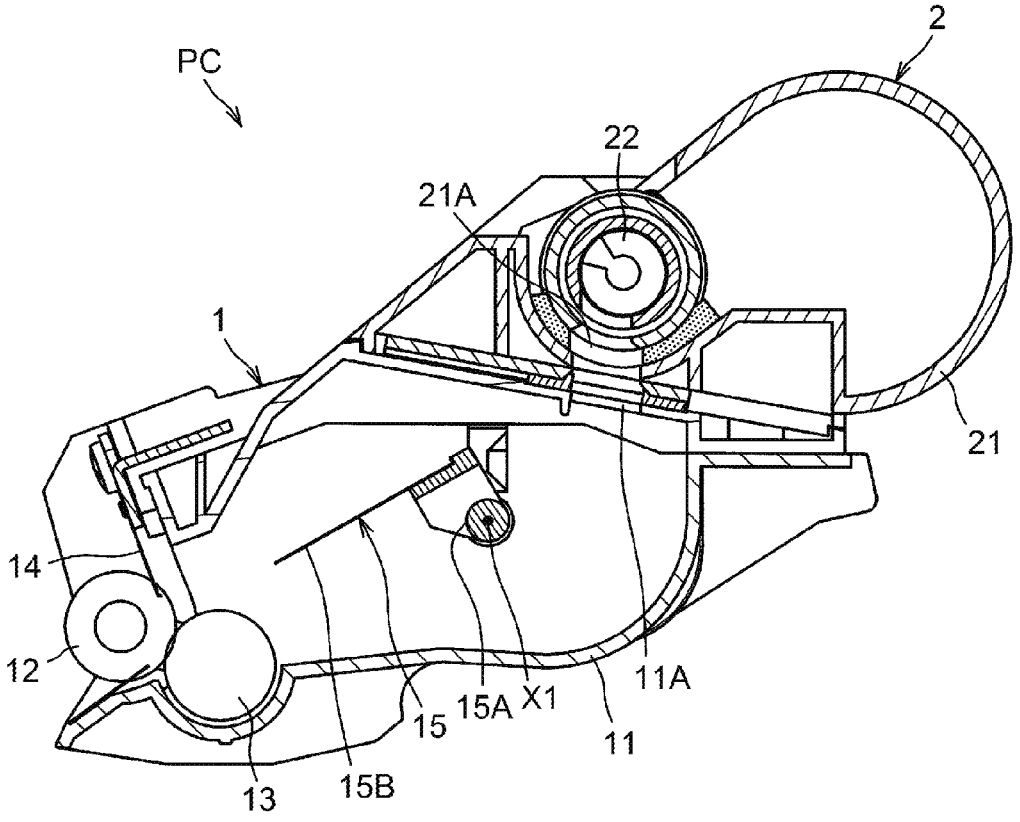
FIG. 1 is a cross-sectional view of a process cartridge including a developing cartridge in an illustrative embodiment according to one or more aspects of the disclosure.

As depicted in FIG. 1, a process cartridge PC includes a developing cartridge 1 and a developer cartridge 2.

The developing cartridge 1 includes a casing 11, a developing roller 12, a supply roller 13, a layer-thickness regulating blade 14, and an agitator 15. The casing 11 is configured to contain developer or developing agent. The casing 11 supports the blade 14. The casing 11 also supports the developing roller 12, the supply roller 13 and the agitator 15, to allow those components 12, 13, and 15 to rotate.

The developing roller 12 is configured to supply the developer to an electrostatic latent image on a photosensitive member (not shown). The developing roller 12 includes a shaft extending along its axis in an axial direction. The developing roller 12 is configured to rotate about the shaft.

The supply roller 13 is configured to supply the developer in the casing 11 to the developing roller 12. The blade 14 is configured to regulate a thickness of the developer on the developing roller 12.

The agitator 15 includes a rotation shaft 15A and an agitator blade 15B. The rotation shaft 15A is configured to rotate about a first axis X1, which extends along the axial direction. The rotation shaft 15A is rotatably supported by the casing 11. The agitator blade 15B is fixed to the rotation shaft 15A. The agitator blade 15B is configured to rotate together with the rotation shaft 15A, to agitate the developer in the casing 11.

The developer cartridge 2 is configured to be attached and removed relative to the developing cartridge 1. The developer cartridge 2 includes a casing 21 and a conveyance member 22. The casing 21 contains developer. The conveyance member 22 is configured to convey the developer in the casing 21 to the developing cartridge 1. The conveyance member 22 is configured to rotate about its axis extending in the axial direction. The rotation of the conveyance member 22 causes the developer in the casing 21 to be conveyed along the axial direction. More specifically, the conveyance member 22 includes an auger screw, which has a shaft around which a helical screw blade is provided. The conveyance member 22 may include a rotation shaft and a screw blade, which is integral with the rotation shaft. Alternatively, the conveyance member 22 may include a rotation shaft and a film screw blade that are separate members.

The casing 21 has an outlet 21A that allows the developer in the casing 21 to flow therethrough to the developing cartridge 1. The casing 11 of the developing cartridge 1 has an inlet 11A facing the outlet 21A. The outlet 21A and the inlet 11A are provided below the conveyance member 22 and at one side of the conveyance member 22 in the axial direction. The developer conveyed by the conveyance member 22 toward the one side in the axial direction is supplied into the casing 11, via the outlet 21A and the inlet 11A.

Figure 9A:
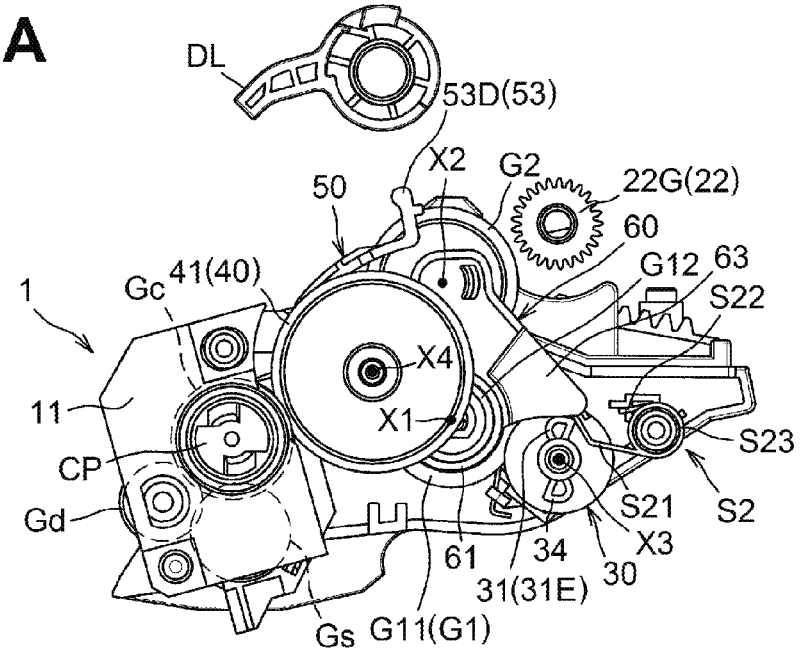
FIG. 9A is a side view of components when a second gear is at a first position.

As depicted in FIG. 9A, the conveyance member 22 includes a driven gear 22G for rotating the conveyance member 22. The driven gear 22G is disposed at a position in which the driven gear 22G is allowed to receive drive force from a rotatable second gear G2 (described below) of the developing cartridge 1 when the developer cartridge 2 is attached to the developing cartridge 1. The driven gear 22G is supported by the shaft of the conveyance member 22.

Figure 2:
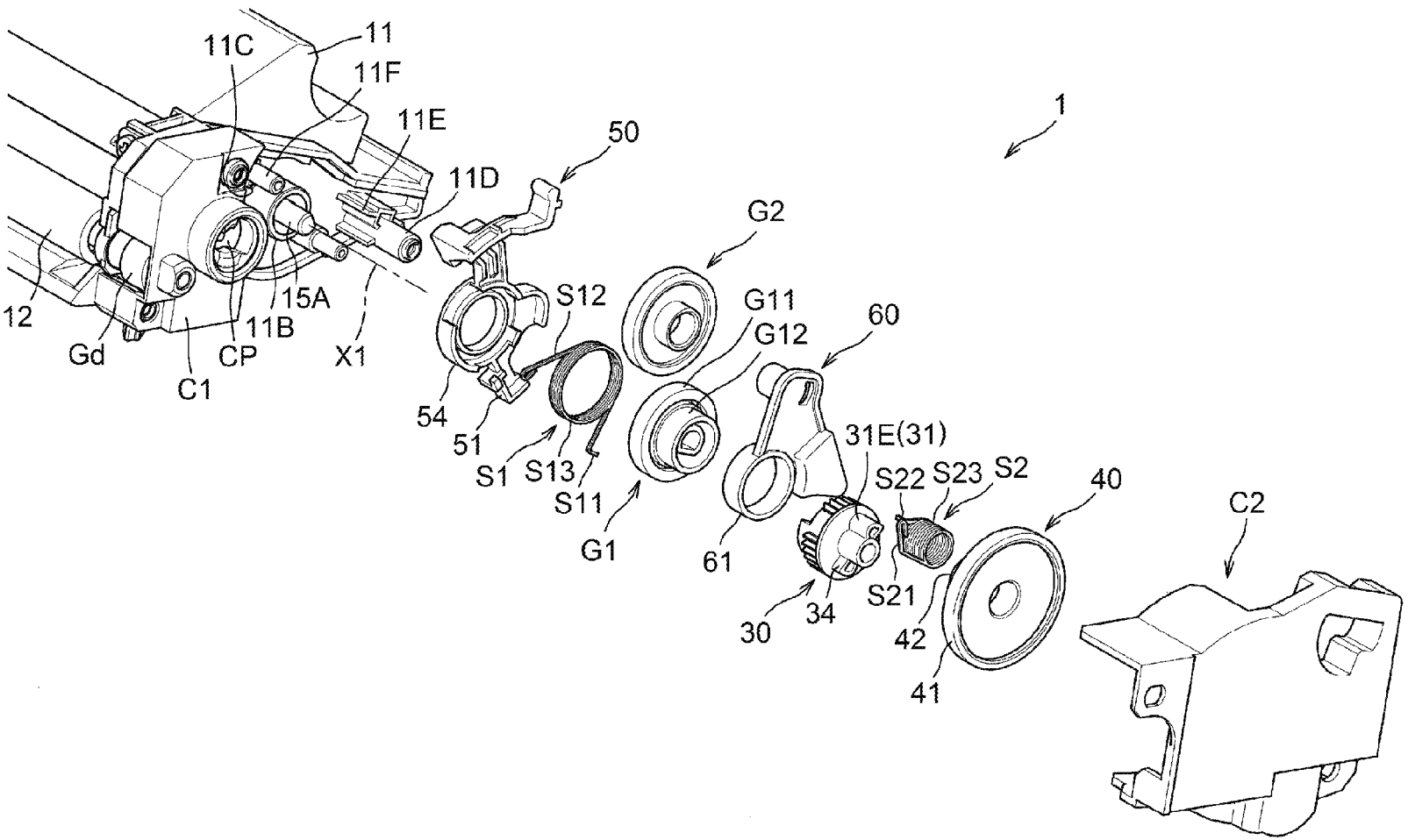
FIG. 2 is a partially exploded perspective view of the developing cartridge of FIG. 1, wherein the developing cartridge is viewed from an outer side.

As depicted in FIGS. 2 and 9A, the developing cartridge 1 includes a coupling CP, a developing roller gear Gd, a supply roller gear Gs, a fourth gear 40, a first gear G1, a second gear G2, a third gear 30, a lever 50, a support member 60, a first spring S1, and a second spring S2. The developing cartridge 1 further includes a first cover C1 and a second cover C2, both disposed at one side of the casing 11 in the axial direction. In the orientation of a transmission seen in FIG. 2, the first cover C1 will be referred to as an "inner/inside" cover and the opposite second cover C2 will be referred to as an "outer/outside" cover as will various other parts of the transmission. The first cover C1 allows a portion of the coupling CP to be exposed therethrough. The first cover C1 covers another portion of the coupling CP, the developing roller gear Gd, and the supply roller gear Gs from outside. The second cover C2 covers the fourth gear 40, the first gear G1, the second gear G2, the third gear 30, the lever 50, the support member 60, the first spring S1, and the second spring S2 from outside.

The first spring S1, e.g., a torsion spring, is provided for biasing the lever 50 in its rotating direction. The first spring S1 includes a coiled portion S13, a first stick portion S11, and the second stick portion S12. The first stick portion S11 extends outward in a radial direction of the coiled portion S13 from an end portion of the coiled portion S13. The second stick portion S12 extends outward in a radial direction of the coiled portion S13 from the other, opposite end portion of the coiled portion S13 in the axial direction. The coiled portion S13 is located inside a main body 54 of the lever 50 (described below). The second stick portion S12 is engaged with a protrusion 11C of the casing 11. The protrusion 11C is a rib protruding outward from an outer peripheral surface of a boss 11F, which rotatably supports the fourth gear 40. The first stick portion S11 is engaged with a first arm 51 (described below) of the lever 50.

The second spring S2, e.g., a torsion spring, is provided for biasing the third gear 30. The second spring S2 includes a coiled portion S23, a first stick portion S21, and a second stick portion S22. The first stick portion S21 extends outward in a radial direction of the coiled portion S23 from an end portion of the coiled portion S23. The second stick portion S22 extends outward in a radial direction of the coiled portion S23 from the other, opposite end portion of the coiled portion S23 in the axial direction. The coiled portion S23 is supported by a support shaft 11D of the casing 11. The support shaft 11D protrudes from the casing 11 in the axial direction. The second stick portion S22 is engaged with a projecting portion 11E on the casing 11. The first stick portion S21 is configured to engage a first spring engagement portion 31E or a second spring engagement portion 34 (described below) of the third gear 30.

The coupling CP is configured to rotate about its axis extending along the axial direction. The coupling CP is configured to receive drive force from a drive source, e.g., a motor, provided in a housing of an image forming apparatus. The coupling CP includes a coupling gear Gc coaxial therewith. The coupling gear Gc is configured to rotate together with the coupling CP.

The developing roller gear Gd is provided for driving the developing roller 12. The developing roller gear Gd is fixedly mounted on an end portion of the shaft of the developing roller 12. The developing roller gear Gd is engaged with the coupling gear Gc. This configuration allows the developing roller gear Gd to receive drive force from the coupling gear Gc and rotate together with the developing roller 12.

The supply roller gear Gs is provided for driving the supply roller 13. The supply roller gear Gs is fixedly mounted on an end portion of a rotation shaft of the supply roller 13. The supply roller gear Gs is engaged with the coupling gear Gc. This configuration allows the supply roller gear Gs to receive the drive force from the coupling gear Gc and rotate together with the supply roller 13.

The fourth gear 40 is configured to rotate about a fourth axis X4 extending in the axial direction. More specifically, the fourth gear 40 is rotatably supported by the boss 11F. The fourth gear 40 includes a large-diameter gear 41 and a small-diameter gear 42, which may be integrally formed. The large-diameter gear 41 is located farther from an outer surface of the casing 11 in the axial direction than the small-diameter gear 42. The large-diameter gear 41 faces a surface of the first gear G1 opposite to the casing 11. The large-diameter gear 41 is engaged with the coupling gear Gc. This configuration allows the large-diameter gear 41 to receive the drive force from the coupling CP and rotate about the fourth axis X4 together with the small-diameter gear 42.

The small-diameter gear 42 is located between the casing 11 and the large-diameter gear 41 in the axial direction. The small-diameter gear 42 is smaller than the large-diameter gear 41 with respect to the outside diameter. As depicted in FIG. 9C, the small-diameter gear 42 is engaged with the first gear G1. This configuration allows the small-diameter gear 42 to transmit the drive force to the first gear G1. The drive force causes the first gear G1 to rotate.

The first gear G1 is configured to rotate about a first axis X1 extending along the axial direction. The first gear G1 is fixedly mounted on the rotation shaft 15A of the agitator 15. In other words, the rotation shaft 15A of the agitator 15 supports the first gear G1. This configuration allows the first gear G1 to rotate together with the agitator 15.

As depicted in FIGS. 2 and 9A, the first gear G1 includes gear teeth G11 formed therearound and a second cylindrical portion G12 extending in the axial direction from a side of the first gear G1 opposite to the casing 11. The second cylindrical portion G12 rotatably supports an inner peripheral surface of a first cylindrical portion 61 (described below) of the support member 60. The first cylindrical portion 61 is located at one end portion of the support member 60. The first cylindrical portion 61 is located inside an addendum circle of the gear teeth G11 of the first gear G1.

The second cylindrical portion G12 is located between the casing 11 and the large-diameter gear 41 in the axial direction. The second cylindrical portion G12 overlaps the large-diameter gear 41 when viewed from the axial direction. The second cylindrical portion G12 has a cylindrical shape with its center corresponding to (e.g., aligned with) the first axis X1 (refer to FIG. 9C).

Figure 9B:
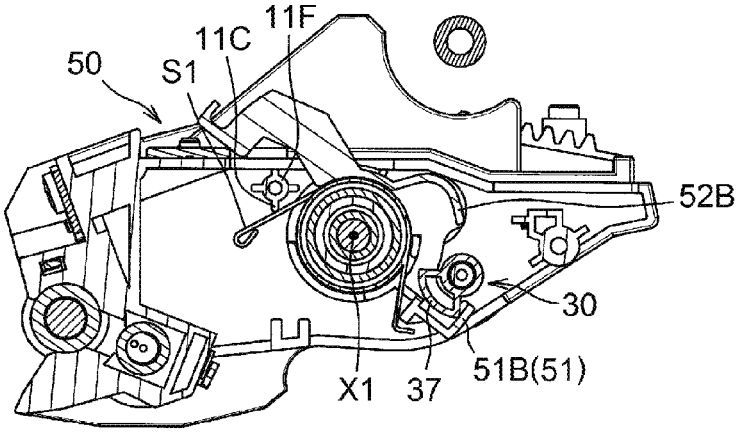
FIG. 9B is a cross-sectional view taken along a line I-I of FIG. 11 when the second gear is at the first position.
Figure 9C:
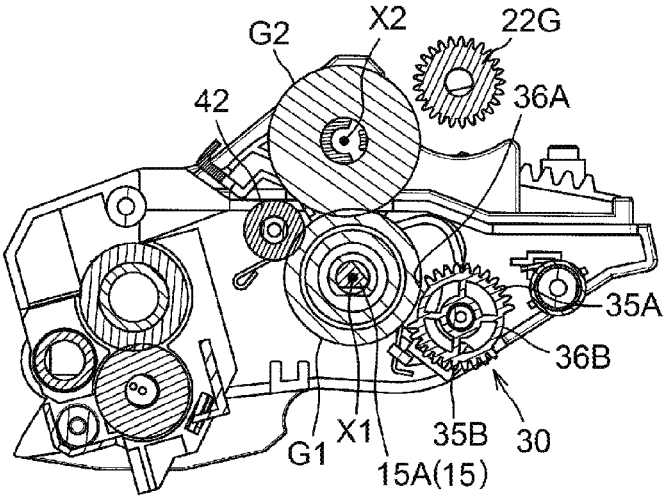
FIG. 9C is a cross-sectional view taken along a line II-II of FIG. 11 when the second gear is at the first position.

As depicted in FIG. 9C, the second gear G2 is configured to rotate about a second axis X2 extending along the axial direction. The second gear G2 is engaged with the first gear G1. The second gear G2 is configured to pivotally move about the first axis X1 relative to the first gear G1. More specifically, the second gear G2 is configured to pivotally move between a first position, as depicted in FIG. 9C, and a second position, as depicted in FIG. 10C. At the first position, the second gear G2 is disengaged from the driven gear 22G. At the second position, the second gear G2 is engaged with the driven gear 22G. This configuration allows the second gear G2 at the second position to transmit the drive force to the driven gear 22G.

As depicted in FIGS. 2 and 9A, the support member 60 rotatably supports the first gear G1 and the second gear G2. The support member 60 is configured to pivotally move about the first axis X1 (refer to FIG. 9C) together with the second gear G2 between the first position and the second position.

Figure 3A:
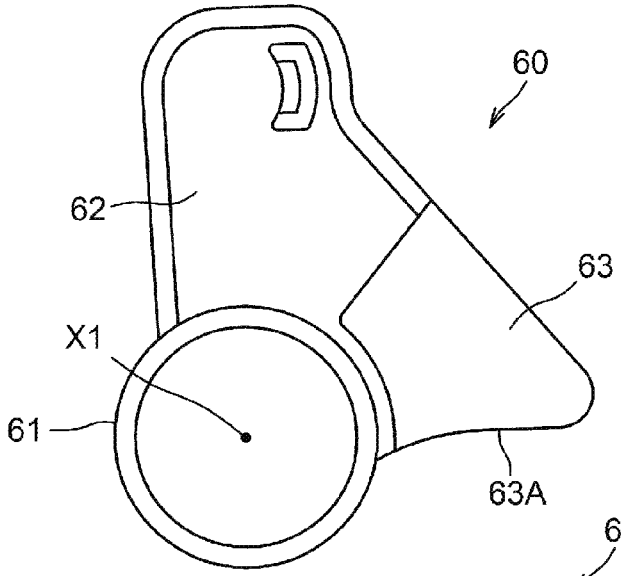
FIG. 3A is a plane view of a support member as viewed along an axis X1 from the outer side.
Figure 3B:
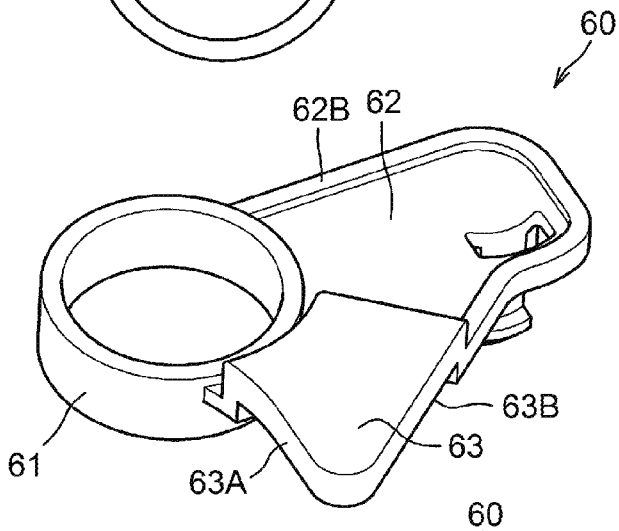
FIG. 3B is a perspective view of the support member as viewed from the outer side.
Figure 3C:
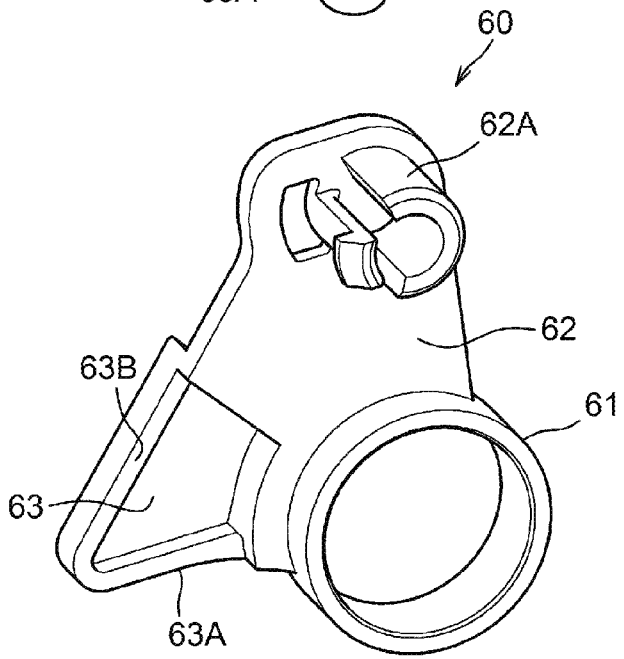
FIG. 3C is a perspective view of the support member as viewed from an inner side opposite to the outer side.

As depicted in FIGS. 3A-3C, the support member 60 includes the first cylindrical portion 61, a first extending portion 62, and a second extending portion 63. The first extending portion 62 extends from the first cylindrical portion 61 in a radial direction of the first gear G1. The second extending portion 63 extends from the first cylindrical portion 61 and the first extending portion 62 toward the third gear 30 (refer to FIG. 9A). The first cylindrical portion 61 is provided at one end portion of the first extending portion 62 in the radial direction of the first gear G1. The first cylindrical portion 61 has a cylindrical shape with its center corresponding to (e.g., aligned with) the first axis X1.

The first extending portion 62 includes a cylindrical support shaft portion 62A at an end portion of the first extending portion 62 opposite to the first cylindrical portion 61. The support shaft portion 62A protrudes from the first extending portion 62 inwardly in the axial direction (e.g., toward the first cover C1 in FIG. 2). The support shaft portion 62A rotatably supports the second gear G2. The first extending portion 62 includes a rib 62B protruding from a peripheral edge portion thereof outwardly in the axial direction (e.g., toward the second cover C2 in FIG. 2).

The second extending portion 63 includes a curved portion 63A configured to contact a cam surface 31D (described below). The curved portion 63A curves along the cam surface 31D (refer to FIG. 9A). More specifically, the curved portion 63A extends from the first cylindrical portion 61 concavely toward a third axis X3 (described below). The second extending portion 63 includes a rib 63B protruding from a peripheral edge portion thereof inwardly in the axial direction. An inner end surface of the rib 63B in the axial direction faces an end surface of the rib 62B of first extending portion 62. The inner end surface of the rib 63B connects to the rib 62B. The second extending portion 63 is thus positioned outside relative to the first extending portion 62 in the axial direction.

As depicted in FIG. 9A, the third gear 30 is configured to rotate about the third axis X3 extending in the axial direction. The third gear 30 includes a cam 31 configured to move the second gear G2 between the first position and the second position. The third gear 30 and the cam 31 are integrated into one unit. The third gear 30 and the cam 31 are configured to rotate about the third axis X3.

Figure 4A:
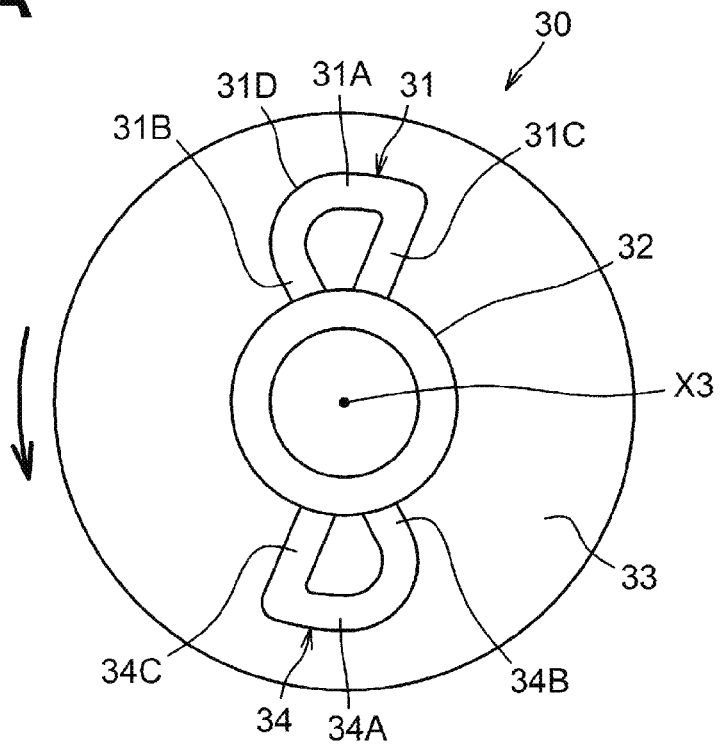
FIG. 4A is a plane view of a third gear as viewed along an axis X3 from the outer side.
Figure 4B:
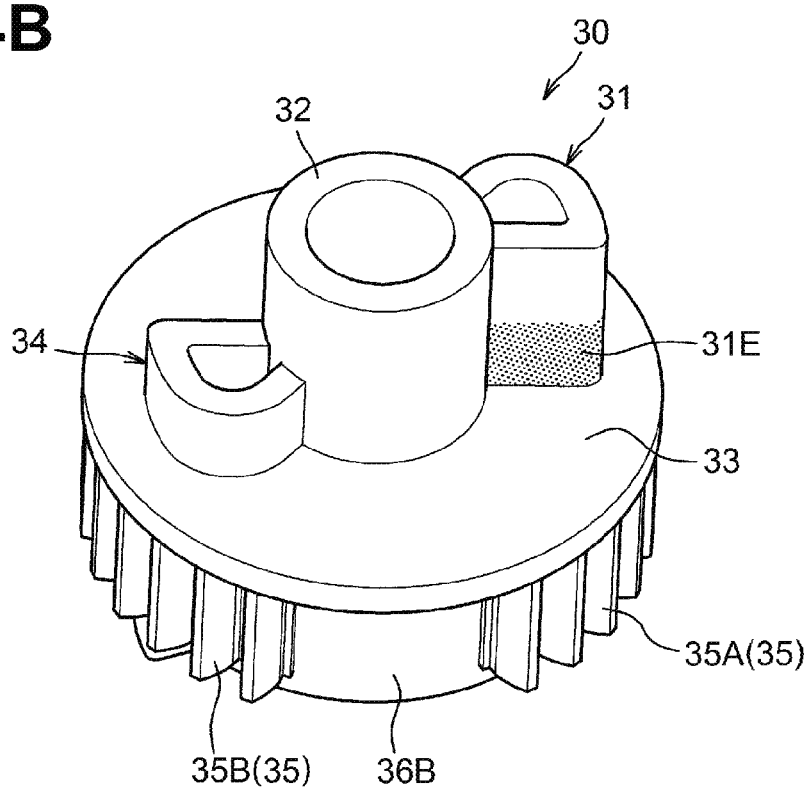
FIG. 4B is a perspective view of the third gear as viewed from the outer side.

More specifically, as depicted in FIGS. 4A and 4B, the third gear 30 includes a rotation shaft 32, a disk portion 33, the cam 31, and a second spring engagement portion 34, which are integrated into one unit. Each of the rotation shaft 32 and the disk portion 33 has its center corresponding to the third axis X3. The rotation shaft 32 is rotatably supported by the casing 11. Each of the cam 31 and the second spring engagement portion 34 protrudes outwardly in the axial direction (e.g., toward the second cover C2 in FIG. 2) from the disk portion 33. The disk portion 33 extends radially outward from a central portion of the rotation shaft 32 in the axial direction.

Figure 10A:
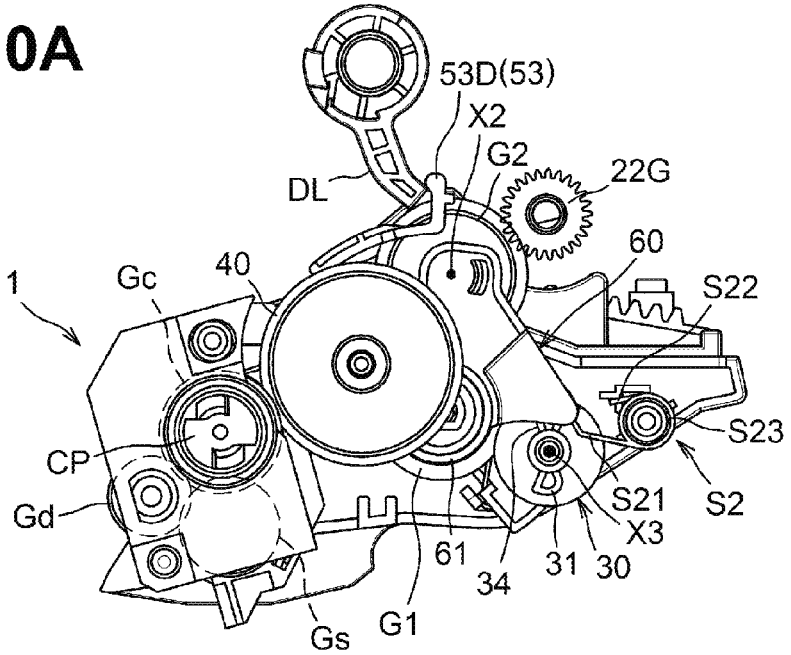
FIG. 10A is a side view of the components when the second gear is at a second position.

The second spring engagement portion 34 is configured to engage the first stick portion S21 of the second spring S2 (refer to FIG. 10A). The second spring engagement portion 34 protrudes from a surface of the disk portion 33 opposite to the casing 11. The second spring engagement portion 34 is spaced from the cam 31 in a rotating direction of the third gear 30. More specifically, the second spring engagement portion 34 is located opposite to the cam 31 with respect to the third axis X3. The second spring engagement portion 34 includes a fourth portion 34A, a fifth portion 34B, and a sixth portion 34C. The fourth portion 34A extends in the rotating direction of the third gear 30. The fifth portion 34B extends from one end portion of the fourth portion 34A in the rotating direction of the third gear 30 toward the third axis X3. The sixth portion 34C extends from the other end portion of the fourth portion 34A in the rotating direction of the third gear 30 toward the third axis X3.

The fourth portion 34A extends from the sixth portion 34C generally along the rotating direction of the third gear 30 toward the fifth portion 34B while curving arcuately. The fifth portion 34B and the sixth portion 34C are connected to the rotation shaft 32. The fourth portion 34A is positioned inside a tooth tip of a gear teeth portion 35 (described below) of the third gear 30 with respect to the radial direction of the third gear 30.

The cam 31 protrudes from a surface of the disk portion 33 opposite to the casing 11. The cam 31 is longer than the second spring engagement portion 34 with respect to the axial direction. The cam 31 includes a first portion 31A, a second portion 31B, and a third portion 31C. The first portion 31A extends in the rotating direction of the third gear 30. The second portion 31B extends from one end portion of the first portion 31A in the rotating direction of the third gear 30 toward the third axis X3. The third portion 31C extends toward the third axis X3 from the other end portion of the first portion 31A in the rotating direction of the third gear 30.

The first portion 31A extends from the third portion 31C generally along the rotating direction of the third gear 30 toward the second portion 31B while curving arcuately. The second portion 31B and the third portion 31C are connected to the rotation shaft 32. The outer peripheral surface of the first portion 31A serves as the cam surface 31D configured to contact the support member 60 (refer to FIG. 9A). The first portion 31A is positioned inside the tooth tip of the gear teeth portion 35 (described in further detail below) of the third gear 30 with respect to the radial direction of the third gear 30.

More specifically, when the second gear G2 is at the first position as depicted in FIG. 9A, the cam 31 (e.g., the cam surface 31D) is in contact with the curved portion 63A of the support member 60. When the second gear G2 is at the second position as depicted in FIG. 10A, the cam 31 is out of contact with the support member 60. The rotating cam 31 may press the support member 60 to move the support member 60 together with the second gear G2. Accordingly, the second gear G2 may move from the second position to the first position. Rotation of the cam 31 in a direction away from the support member 60 may cause the second gear G2 at the first position to move to the second position together with the support member 60. During the movement of the second gear G2 from the first position to the second position, the support member 60 moves together with the second gear G2 while being supported by the cam 31.

A distance between the second axis X2 and the third axis X3 when the support member 60 is in contact with the cam 31 is longer than a distance between the second axis X2 and the third axis X3 when the support member 60 is out of contact with the cam 31. In other words, the second gear G2 at the first position is further away from the third axis X3 than at the second position. More specifically, the distance between the second axis X2 and the third axis X3 when the second gear G2 is at the first position is longer than the distance between the second axis X2 and the third axis X3 when the second gear G2 is at the second position.

As depicted in FIGS. 4A and 4B, the cam 31 includes a first spring engagement portion 31E at an end portion thereof closer to the disk portion 33. The first spring engagement portion 31E is shown with hatching in FIG. 4B. The first spring engagement portion 31E is engageable with the second spring S2 (refer to FIG. 9A). The first spring engagement portion 31E has the same length as the second spring engagement portion 34 with respect to the axial direction.

A distance between the second extending portion 63 of the support member 60 and the disk portion 33 in the axial direction is longer than each of the lengths of the first spring engagement portion 31E and the second spring engagement portion 34 in the axial direction. As depicted in FIGS. 9A and 10A, the second spring S2, which is configured to bias the first spring engagement portion 31E or the second spring engagement portion 34, is located more inward in the axial direction than the second extending portion 63. This configuration may prevent the second spring S2 from contacting the second extending portion 63.

Figure 5A:
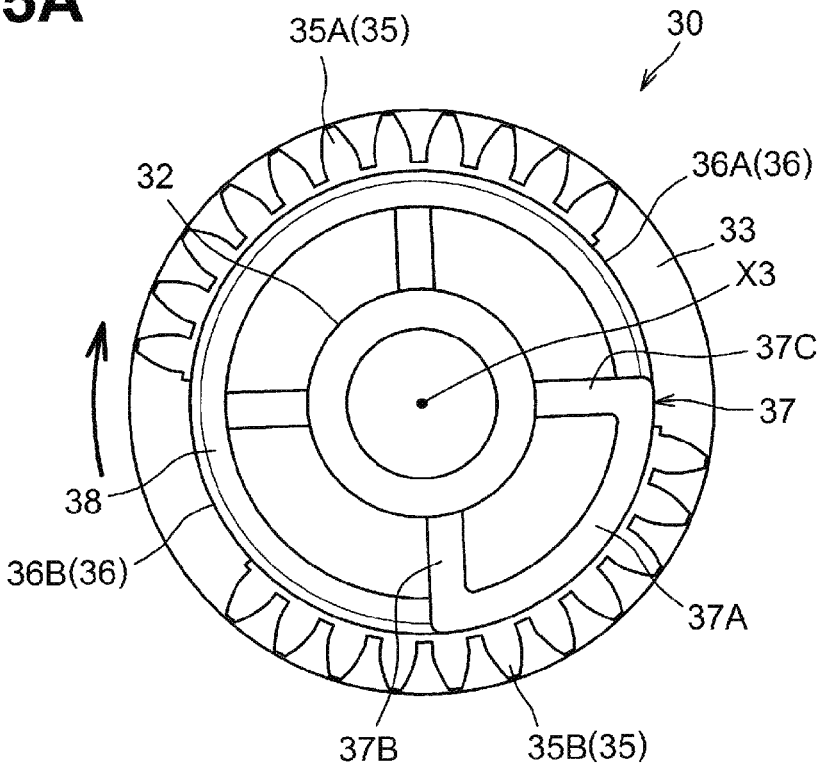
FIG. 5A is a plane view of the third gear as viewed along the axis X3 from the inner side.
Figure 5B:
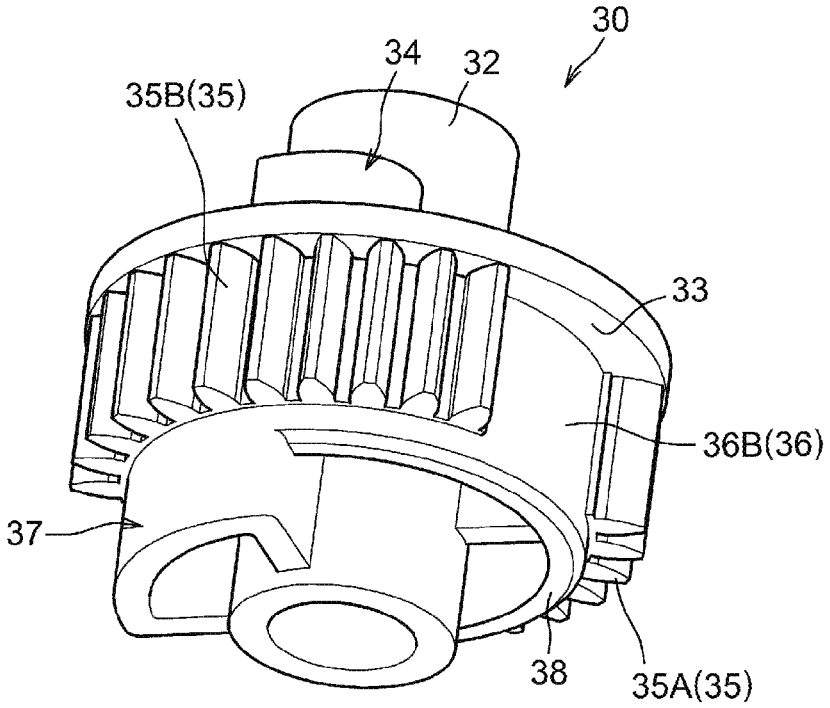
FIG. 5B is a perspective view of the third gear as viewed from the inner side.

As depicted in FIGS. 5A and 5B, the third gear 30 includes, at a peripheral surface thereof, the gear teeth portion 35 and a toothless portion 36. Each of the gear teeth portion 35 and the toothless portion 36 protrudes inward in the axial direction (e.g., in a direction opposite to an extending direction of the cam 31) from the disk portion 33. More specifically, the gear teeth portion 35 is provided at a peripheral surface of the cylindrical portion 38 protruding inward in the axial direction from the disk portion 33. The toothless portion 36 constitutes a portion of the peripheral surface of the cylindrical portion 38. The cylindrical portion 38 is coaxial with the rotation shaft 32. The cylindrical portion 38 has a greater diameter than the rotation shaft 32.

The gear teeth portion 35 includes a first gear teeth portion 35A and a second gear teeth portion 35B. The first gear teeth portion 35A is disposed opposite to the second gear teeth portion 35B with respect to the third axis X3. A portion of the first gear teeth portion 35A is located between the first spring engagement portion 31E and the second spring engagement portion 34 in the rotating direction of the third gear 30. A portion of the second gear teeth portion 35B is located between the first spring engagement portion 31E and the second spring engagement portion 34 in the rotating direction of the third gear 30.

The first gear teeth portion 35A and the second gear teeth portion 35B are arranged such that those portions 35A and 35B are allowed to engage with the first gear G1 (refer to FIG. 9C). In other words, an addendum circle of each of the first gear teeth portion 35A and the second gear teeth portion 35B overlaps an addendum circle of the gear teeth G11 of the first gear G1. The first gear teeth portion 35A engages the first gear G1 when the second gear G2 moves from the first position (e.g., position in FIG. 9A) to the second position (e.g., position in FIG. 10A). The second gear teeth portion 35B engages the first gear G1 when the second gear G2 moves from the second position (e.g., position in FIG. 10A) to the first position (e.g., position in FIG. 9A). Engagement of the first gear teeth portion 35A or the second gear teeth portion 35B with the first gear G1 allows the drive force to be transmitted from the first gear G1 to the third gear 30. The drive force may cause the cam 31 to rotate by a predetermined angle (e.g., approximately 180 degrees).

The toothless portion 36 includes a first toothless portion 36A and a second toothless portion 36B. The first toothless portion 36A is disposed opposite to the second toothless portion 36B with respect to the third axis X3. In other words, the first toothless portion 36A or the second toothless portion 36B is located between the first gear teeth portion 35A and the second gear teeth portion 35B in the rotating direction of the third gear 30.

The first toothless portion 36A and the second toothless portion 36B are each located between the first spring engagement portion 31E and the second spring engagement portion 34 in the rotating direction of the third gear 30.

When the second gear G2 is at the first position as depicted in FIG. 9C, the first toothless portion 36A faces the first gear G1. When the second gear G2 is at the second position as depicted in FIG. 10C, the second toothless portion 36B faces the first gear G1.

The third gear 30 is configured to rotate between a third position where the gear teeth portion 35 engages the first gear G1, and a fourth position where the toothless portion 36 faces the first gear G1. At the third position, the first gear G1 engages either one of the first gear teeth portion 35A and the second gear teeth portion 35B. At the fourth position, the first gear G1 faces either one of the first toothless portion 36A and the second toothless portion 36B. The third gear 30 receives the drive force from the first gear G1 at the third position, and does not receive the drive force from the first gear G1 at the fourth position.

Referring back to FIGS. 5A and 5B, the third gear 30 includes a protruding portion 37 located at an inner side of the second gear teeth portion 35B in the axial direction. For example, the protruding portion 37 is located between the casing 11 and the gear teeth portion 35 in the axial direction. The protruding portion 37 protrudes outward in the radial direction of the third gear 30 from a peripheral surface of the rotation shaft 32. The protruding portion 37 is located inside an addendum circle of the second gear teeth portion 35B with respect to the radial direction.

The protruding portion 37 includes a seventh portion 37A, an eighth portion 37B, and a ninth portion 37C. The seventh portion 37A extends in the rotating direction of the third gear 30. The eighth portion 37B extends from one end portion of the seventh portion 37A in the rotating direction of the gear 30 toward the third axis X3. The ninth portion 37C extends from an opposite end portion of the seventh portion 37A in the rotating direction of the gear 30 toward the third axis X3. The seventh portion 37A is shaped like an arc of a circle whose center is the third axis X3. The eighth portion 37B and the ninth portion 37C are each connected to the rotation shaft 32.

As depicted in FIG. 2, the casing 11 includes a cylindrical portion 11B whose axis is the first axis X1. The cylindrical portion 11B extends in the axial direction. The cylindrical portion 11B surrounds the rotation shaft 15A of the agitator 15. The cylindrical portion 11B rotatably supports the lever 50. A portion of the lever 50 is located between the first gear G1 and the casing 11 in the axial direction. Another portion of the lever 50 is located between the large-diameter gear 41 and the casing 11 in the axial direction.

Figure 6A:
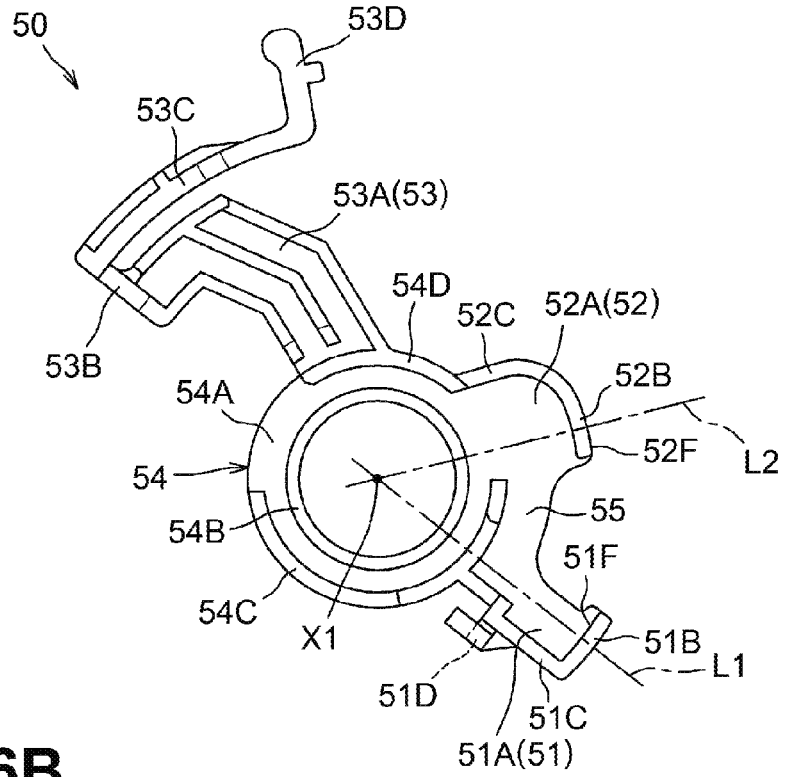
FIG. 6A is a plane view of a lever as viewed along an axis from the outer side.
Figure 6B:
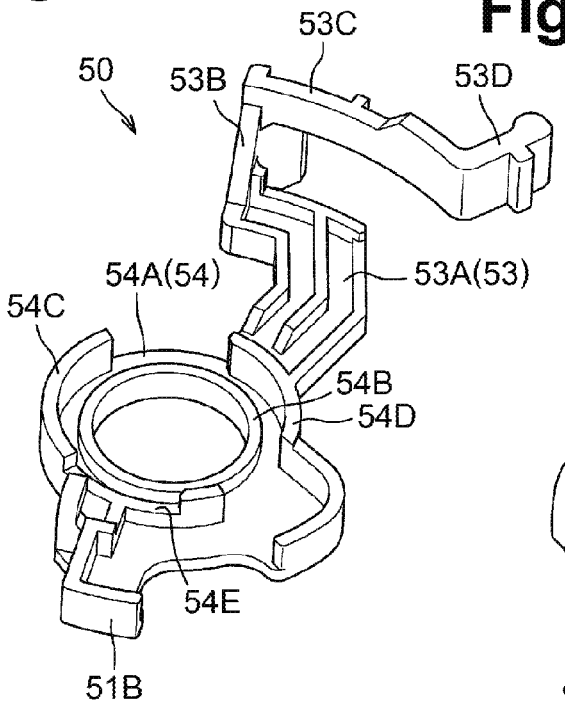
FIG. 6B is a perspective view of the lever as viewed from the outer side.
Figure 6C:
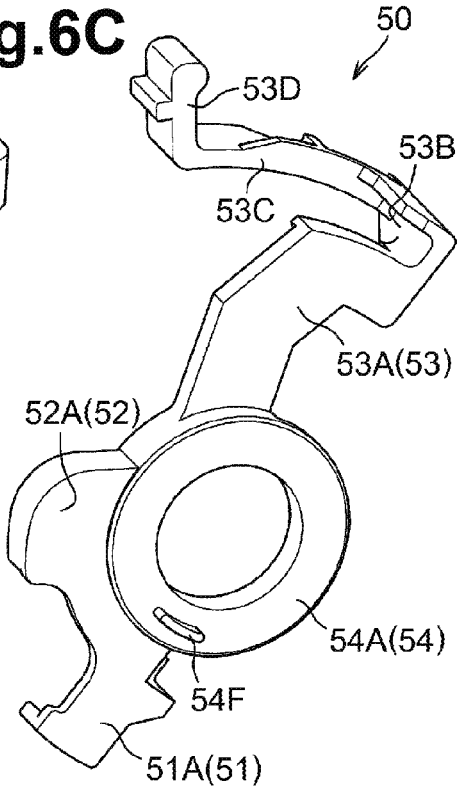
FIG. 6C is a perspective view of the lever as viewed from the inner side.
Figure 10B:
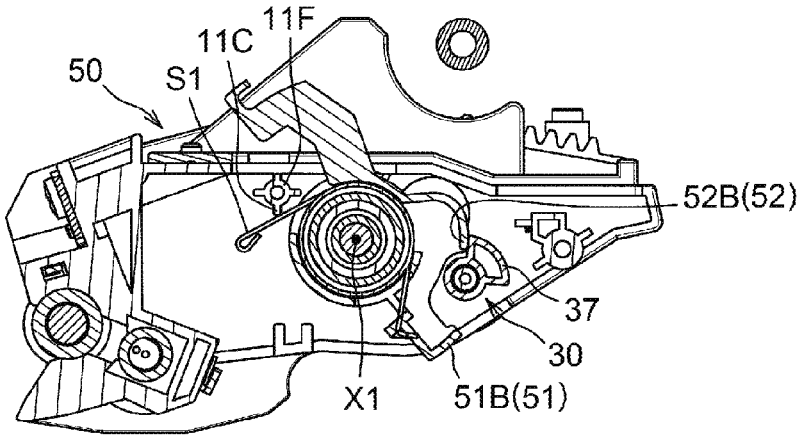
FIG. 10B is a cross-sectional view taken along a line I-I in FIG. 11 when the second gear is at the second position.
Figure 10C:
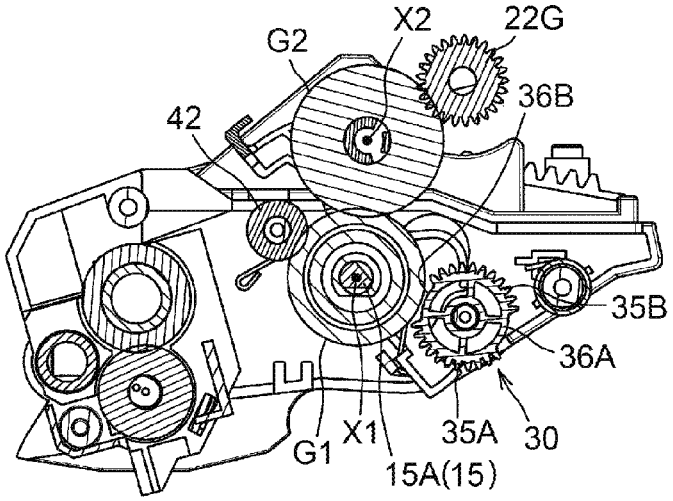
FIG. 10C is a cross-sectional view taken along a line II-II in FIG. 11 when the second gear is at the second position.
Figure 11:
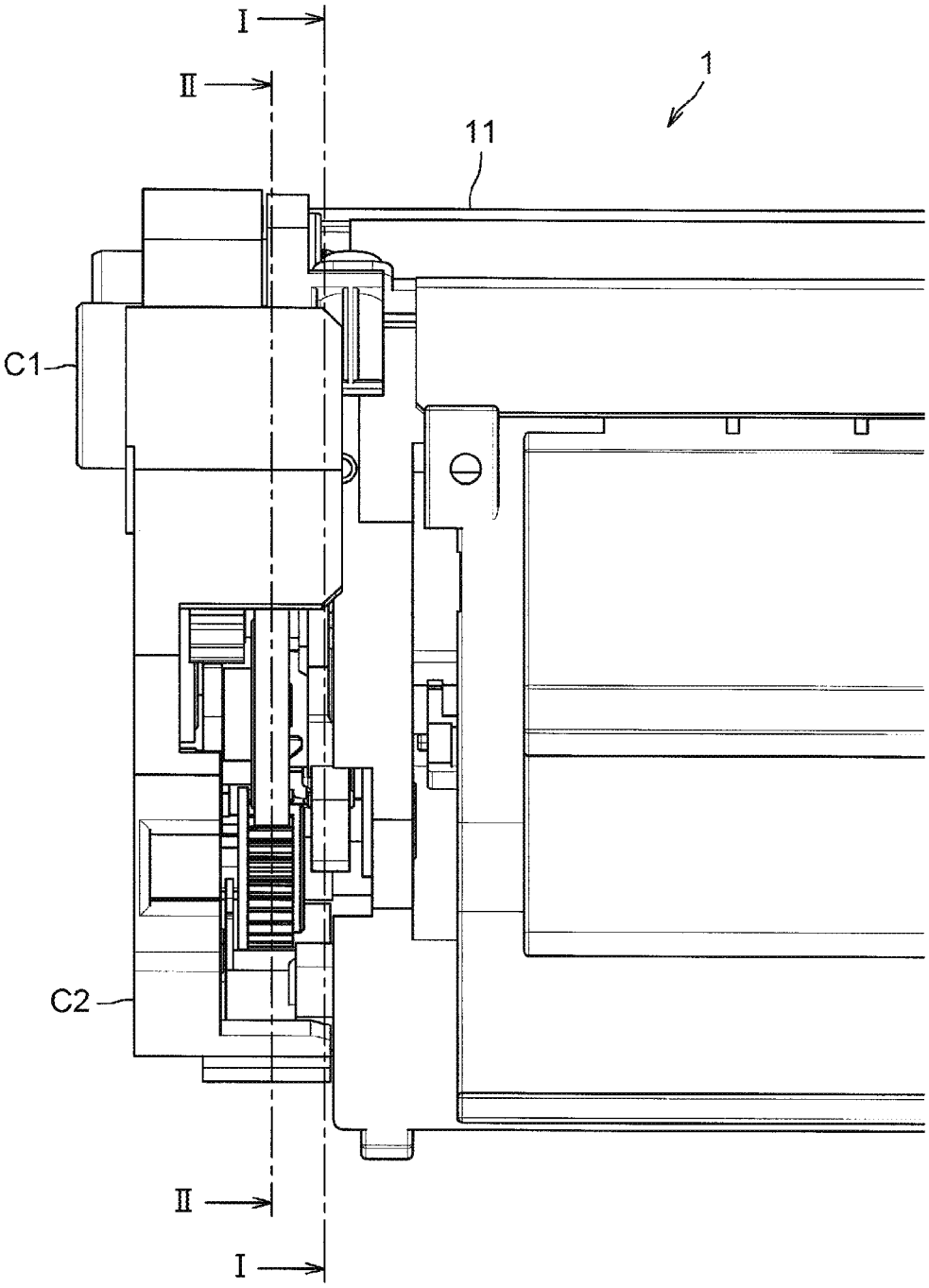
FIG. 11 depicts a first cover and the second cover attached to the casing.

As depicted in FIGS. 6A-6C, the lever 50 is rotatable about the first axis X1 between a fifth position (as depicted in FIG. 9B) and a sixth position (as depicted in FIG. 10B). The lever 50 includes a main body 54, a first arm 51, a second arm 52, and a third arm 53. The main body 54 has a cylindrical shape with its center corresponding to (e.g., aligned with) the first axis X1. The arms 51-53 are rotatable together with the main body 54.

The main body 54 includes a flat portion 54A, an inner flange portion 54B, a first outer flange portion 54C, and a second outer flange portion 54D. The flat portion 54A has a shape of a ring whose center corresponds to the first axis X1. The inner flange portion 54B has a cylindrical shape and protrudes outward in the axial direction from an inner peripheral edge portion of the flat portion 54A. Each of the outer flange portions 54C and 54D protrudes outward in the axial direction from an outer peripheral edge portion of the flat portion 54A. The outer peripheral surface of the inner flange portion 54B and the inner peripheral surfaces of the outer flange portions 54C and 54D define a space for the coiled portion S13 of the first spring S1 (in FIG. 2).

The first outer flange portion 54C is opposite to the second outer flange portion 54D with respect to the first axis X1 (e.g., diametrically opposed). Each end portion of the first outer flange portion 54C in a rotating direction of the lever 50 is spaced from the third arm 53 in the rotating direction. One end portion of the first outer flange portion 54C in the rotating direction of the lever 50 is located between the first arm 51 and the second arm 52 in the rotating direction. The first outer flange portion 54C includes a recessed portion 54E at an outer end face thereof with respect to the axial direction. The recessed portion 54E is recessed inward with respect to the axial direction. A space in the recessed portion 54E receives the first stick portion S11 of the first spring S1 (in FIG. 2) therein. The recessed portion 54E faces a spring hook 51D (described below) of the first arm 51 in a radial direction of the main body 54. The first stick portion S11 of the first spring S1 engages the spring hook 51D through the recessed portion 54E. The first spring S1 thus biases the lever 50 in its rotating direction from the sixth position toward the fifth position (refer to FIGS. 9B and 10B).

The second outer flange portion 54D extends along the rotating direction of the lever 50 from a base end portion of the third arm 53 to a base end portion of the second arm 52. One end portion of the second outer flange portion 54D in the rotating direction (e.g., an end portion opposite to the second arm 52) and the first outer flange portion 54C define a space therebetween. The space receives the second stick portion S12 of the first spring S1 (in FIG. 2) therein.

The flat portion 54A includes a rotation restricting portion 54F at an inner surface thereof in the axial direction. The rotation restricting portion 54F protrudes inward in the axial direction and is located in an arcuate groove (not depicted) of the casing 11. The groove restricts, with its ends, the movement of the rotation restricting portion 54F, thereby positioning or otherwise locating the lever 50 at the fifth or sixth position.

When the lever 50 is at the fifth position, the first arm 51 extends from the main body 54 toward the third gear 30 (refer to FIG. 9B). The first arm 51 includes a flat portion 51A, a first engagement portion 51B, and a connecting portion 51C. The flat portion 51A is orthogonal to the first axis X1. The first engagement portion 51B protrudes outward in the axial direction from an end portion of the flat portion 51A opposite to the main body 54. The connecting portion 51C connects between the first engagement portion 51B and the first outer flange portion 54C of the main body 54.

The first engagement portion 51B has a plate-like shape. The first engagement portion 51B includes a surface 51F orthogonal to a first straight line L1, which is orthogonal to the first axis X1 and passes through the first axis X1. The surface 51F is an inner surface of the first engagement portion 51B with respect to the radial direction of the main body 54. As depicted in FIG. 9B, when the lever 50 is at the fifth position, the surface 51F is engaged with and/or contacts the protruding portion 37 of the third gear 30. In other words, when the lever 50 is at the fifth position, the first engagement portion 51B is within a rotating path of the protruding portion 37. As depicted in FIG. 10B, when the lever 50 is at the sixth position, the first engagement portion 51B is out of the rotating path of the protruding portion 37.

As depicted in FIG. 9C, when the protruding portion 37 is engaged with the first engagement portion 51B, the first toothless portion 36A of the third gear 30 faces the first gear G1. In other words, when the third gear 30 is at the fourth position in which the third gear 30 does not receive drive force from the first gear G1, the first engagement portion 51B is engaged with the protruding portion 37. The third gear 30 is thus maintained in a non-receiving state in which the gear 30 does not receive the drive force from the first gear G1.

When the first engagement portion 51B is engaged with the protruding portion 37 as depicted in FIG. 9A, the second spring S2 is in contact with the first spring engagement portion 31E. The second spring S2 biases the third gear 30 in its rotating direction such that the protruding portion 37 approaches the first engagement portion 51B. At this time, the surface 51F of the first engagement portion 51B configured to receive biasing force from the protruding portion 37, is orthogonal to the first straight line L1. The biasing force is applied to the first engagement portion 51B along the first straight line L1, e.g., the biasing force is not applied in a direction to rotate the lever 50. This configuration may prevent the lever 50 from being rotated by the biasing force.

When the protruding portion 37 is engaged with the first engagement portion 51B, the cam 31 is maintained above the third axis X3 and the second gear G2 is at the first position, as depicted in FIG. 9A.

Referring back to FIGS. 6A-6C, the connecting portion 51C extends outward in the axial direction from an end portion of the flat portion 51A in the rotating direction of the lever 50. The connecting portion 51C includes a spring hook 51D at a generally central portion thereof in the radial direction. The spring hook 51D extends in a direction opposite to the flat portion 51A.

When the lever 50 is at the sixth position, the second arm 52 extends from the main body 54 toward the third gear 30 (refer to FIG. 10B). The second arm 52 includes a flat portion 52A, a second engagement portion 52B, and a connecting portion 52C. The flat portion 52A is orthogonal to the first axis X1. The second engagement portion 52B protrudes outward in the axial direction from an end portion of the flat portion 52A opposite to the main body 54. The connecting portion 52C connects the second engagement portion 52B and the second outer flange portion 54D of the main body 54. The flat portion 52A and the flat portion 51A are connected by a connecting flat portion 55 protruding outward in the radial direction from the main body 54.

The second engagement portion 52B has a plate-like shape. The second engagement portion 52B includes a surface 52F orthogonal to a straight line L2, which is orthogonal to the first axis X1 and passes through the first axis X1. The surface 52F is an outer surface of the second engagement portion 52B with respect to the radial direction of the main body 54. As depicted in FIG. 10B, when the lever 50 is at the sixth position, the surface 52F is engaged with or contact with the protruding portion 37 of the third gear 30. In other words, when the lever 50 is at the sixth position, the second engagement portion 52B is at the rotating path of the protruding portion 37. As depicted in FIG. 9B, when the lever 50 is at the fifth position, the second engagement portion 52B is out of the rotating path of the protruding portion 37.

As depicted in FIG. 10C, when the protruding portion 37 is engaged with the second engagement portion 52B, the second toothless portion 36B of the third gear 30 faces the first gear G1. In other words, when the third gear 30 is at the fourth position in which the third gear 30 does not receive drive force from the first gear G1, the second engagement portion 52B is engaged with the protruding portion 37. The third gear 30 is thus maintained in the non-receiving state in which the gear 30 does not receive the drive force from the first gear G1.

When the second engagement portion 52B is engaged with the protruding portion 37 as depicted in FIG. 10A, the second spring S2 is in contact with the second spring engagement portion 34. The second spring S2 biases the third gear 30 in its rotating direction such that the protruding portion 37 approaches the second engagement portion 52B. At this time, the surface 52F of the second engagement portion 52B configured to receive biasing force from the protruding portion 37, is orthogonal to the second straight line L2. The biasing force is applied to the second engagement portion 52B along the second straight line L2, e.g., the biasing force is not applied in a direction to rotate the lever 50. This configuration may prevent the lever 50 from being rotated by the biasing force.

When the protruding portion 37 is engaged with the second engagement portion 52B, the cam 31 is maintained below the third axis X3, and the second gear G2 is at the second position, as depicted in FIG. 10A.

Referring back to FIG. 6A-6C, the third arm 53 includes a first extending portion 53A, a second extending portion 53B, a third extending portion 53C, and a receiving portion 53D. The first extending portion 53A extends from the main body 54 opposite to the first arm 51 and extends in a rotating direction of the lever 50. The first extending portion 53A includes a flat portion orthogonal to the first axis X1 and a plurality of ribs, each protruding outward in the axial direction from the flat portion.

The second extending portion 53B extends from an end portion of the first extending portion 53A outwardly in the axial direction, as well as in the radial direction. The second extending portion 53B has an "L" shape in cross section.

The third extending portion 53C extends from an end portion of the second extending portion 53B in the rotating direction of the lever 50. The third extending portion 53C has an "L" shape in cross section.

The receiving portion 53D extends outward in the radial direction from an end portion of the third extending portion 53C. The receiving portion 53D is configured to receive external force, e.g., from a drive lever DL (refer to FIG. 10A) disposed in the image forming apparatus.

A distance from the receiving portion 53D to the first axis X1 is longer than a distance from the first engagement portion 51B to the first axis X1. The distance from the receiving portion 53D to the first axis X1 is longer than a distance from the second engagement portion 52B to the first axis X1.

Figure 7A:
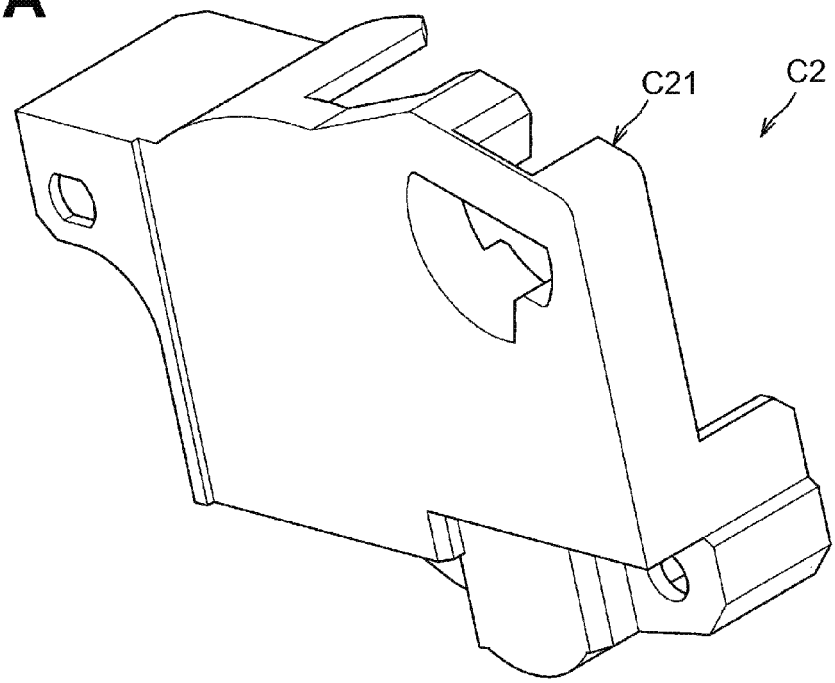
FIG. 7A is a perspective view of a second cover as viewed from the outer side.
Figure 7B:
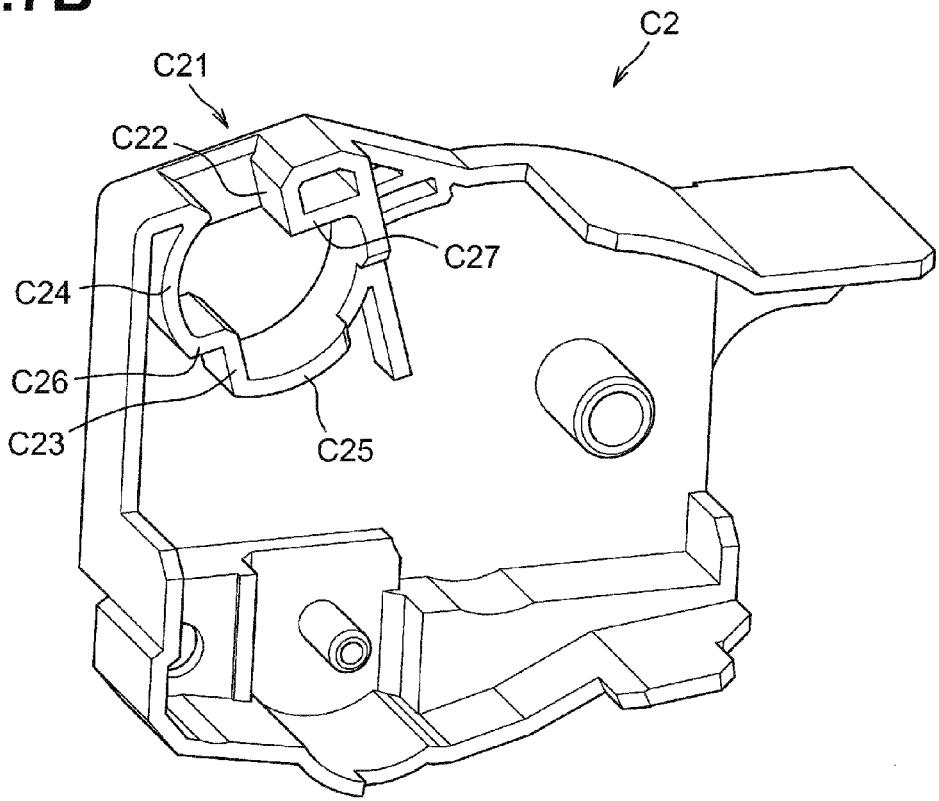
FIG. 7B is a perspective view of the second cover as viewed from the inner side.

As depicted in FIGS. 7A and 7B, the second cover C2 includes a guide portion C21 configured to guide a protrusion 23 (refer to FIG. 8A) provided in the developer cartridge 2. The protrusion 23 is elongated in one direction. A central portion of the protrusion 23 in its longitudinal direction corresponds to an axis of the conveyance member 22 (refer to FIG. 1).

The guide portions C21 includes first guide portions C22 and C23, second guide portions C24 and C25, and third guide portions C26 and C27. The first guide portions C22 and C23 are configured to guide the protrusion 23 along its longitudinal direction. The second guide portions C24 and C25 are configured to guide rotation of the protrusion 23 about the axis of the conveyance member 22. The third guide portions C26 and C27 are configured to restrict the rotation of the protrusion 23. Guide surfaces of the first guide portions C22 and C23 are perpendicular to guide surfaces of the third guide portions C26 and C27.

Figure 8A:
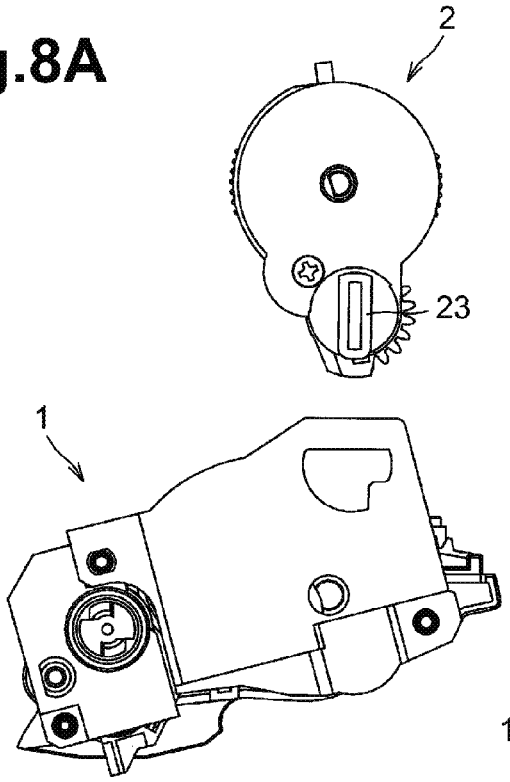
FIGS. 8A-8C depict processes of mounting a developer cartridge to the developing cartridge according to one or more aspects of the disclosure.
Figure 8B:
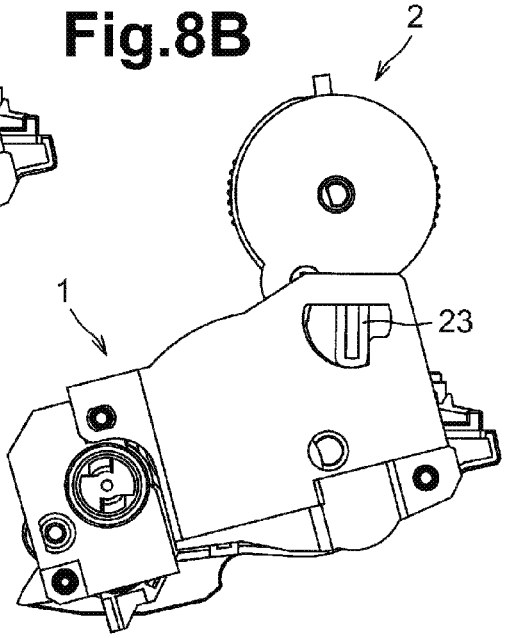
Figure 8C:
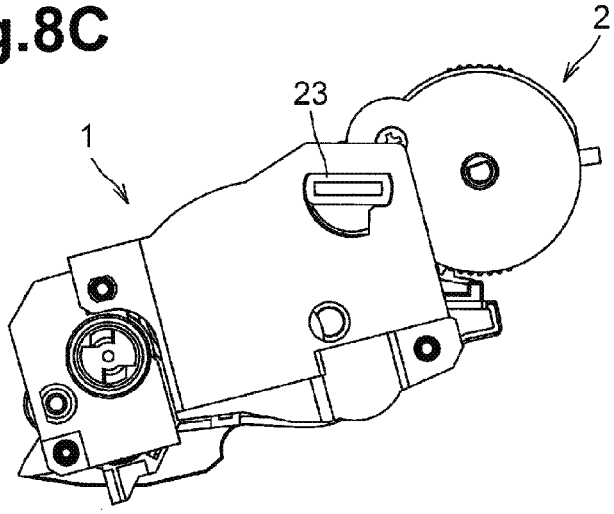

The guide portion C21 allows the developer cartridge 2 to be mounted to the developing cartridge 1 in an orientation as depicted in FIGS. 8A and 8B. The guide portion C21 also allows the developer cartridge 2, which has been mounted on the cartridge 1, to pivot 90 degrees, as depicted in FIG. 8C.

Operations of the process cartridge PC is now described.

To rotate the developing roller 12, the supply roller 13, and the agitator 15 but not the conveyance member 22 as depicted in FIG. 1, the drive lever DL of the image forming apparatus is disengaged from the lever 50, as depicted in FIG. 9A. The lever 50 is located at the fifth position by the biasing force of the first spring S1.

At this time, the protruding portion 37 of the third gear 30 is engaged with the first engagement portion 51B of the lever 50 as depicted in FIG. 9B. As depicted in FIG. 9C, the first toothless portion 36A of the third gear 30 faces the first gear G1. As depicted in FIG. 9A, the support member 60 is raised by the cam 31, and the second gear G2 is located at the first position accordingly.

The image forming apparatus provides drive force to the coupling CP. The drive force is transmitted directly to the developing roller gear Gd and the supply roller gear Gs, as well as to the first gear G1 via the fourth gear 40. The second gear G2, which is disengaged from the driven gear 22G, rotates freely. This configuration allows the developing roller 12, the supply roller 13 and the agitator 15 to rotate without causing the rotation of the conveyance member 22.

Figure 12A:
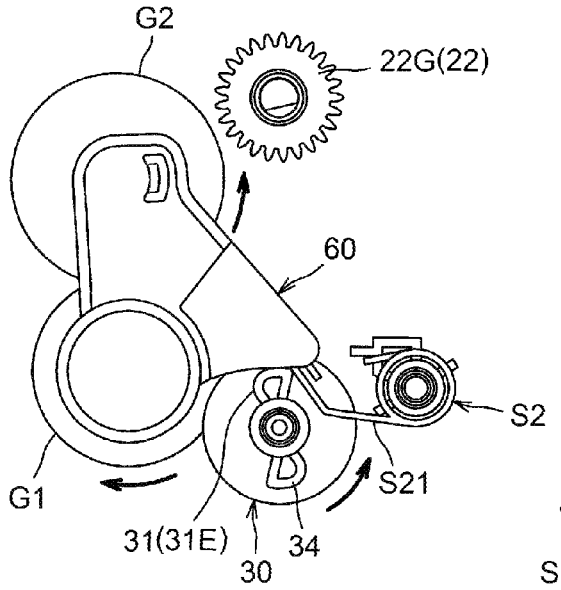
FIGS. 12A-12C depict operations of components when a first engagement portion is disengaged from a protruding portion.
Figure 12B:
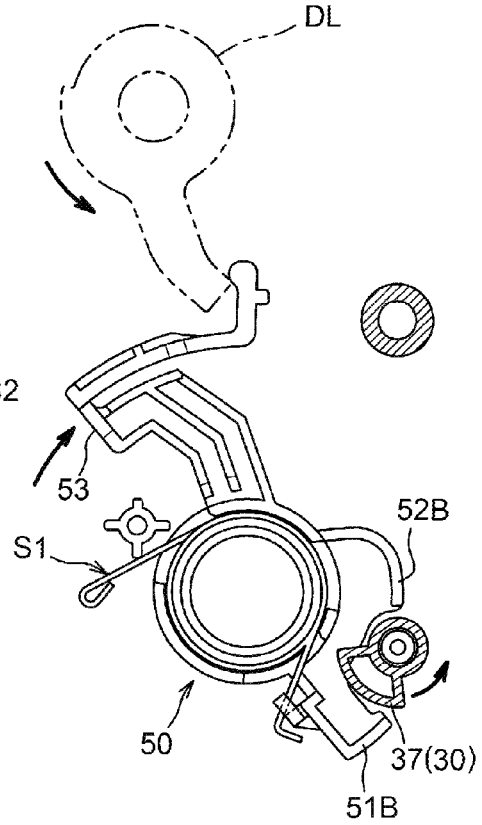

In this state, the drive lever DL may be rotated or pivoted to a position as depicted in FIG. 12B, to press the third arm 53 of the lever 50 against the biasing force of the first spring S1. The lever 50 is thus rotated from the fifth position to the sixth position where the first engagement portion 51B of the lever 50 is disengaged from the protruding portion 37.

Figure 12C:
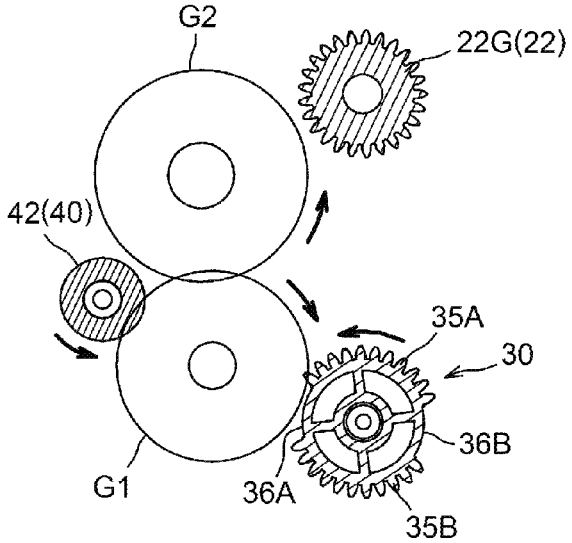

In response to this disengagement of the first engagement portion 51B from protruding portion 37, the third gear 30 is rotated counterclockwise in FIG. 12A, by the biasing force of the second spring S2, resulting in engagement of the first gear teeth portion 35A of the third gear 30 with the first gear G1, as depicted in FIG. 12C.

Figure 13A:
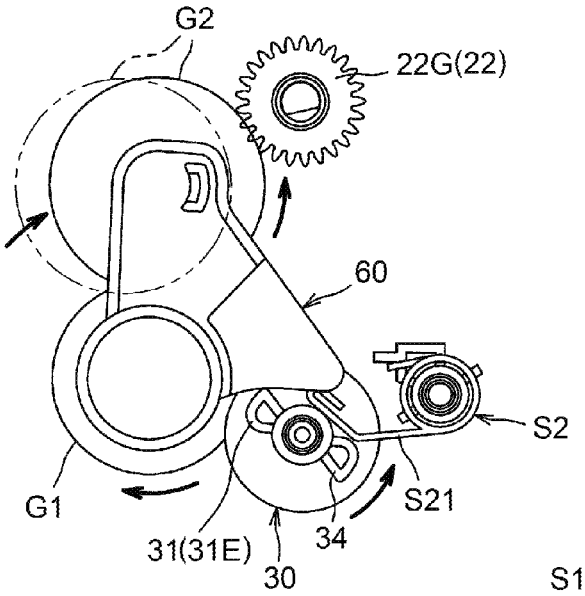
FIGS. 13A-13C depict operations of the components when the second gear has reached the second position from the first position.
Figure 13B:
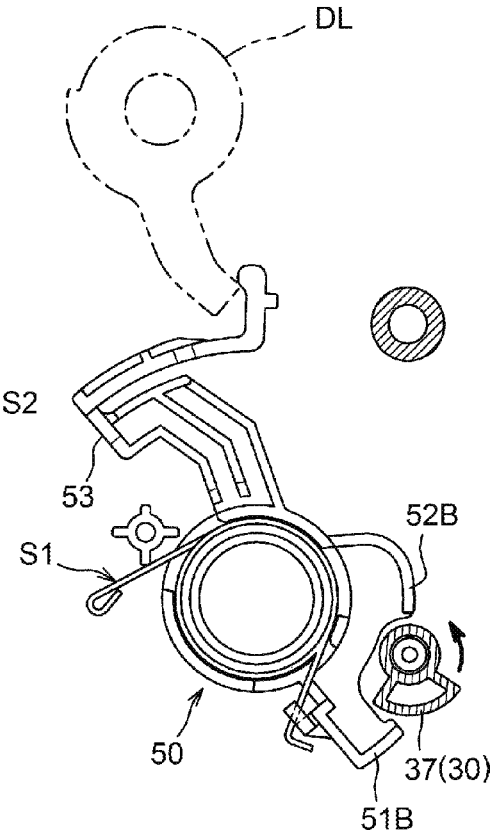
Figure 13C:
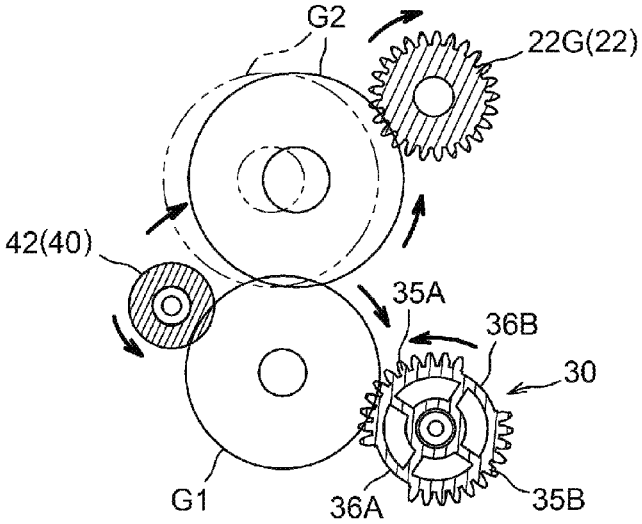

As the first gear teeth portion 35A engages the first gear G1, the drive force is transmitted from the first gear G1 to further rotate the third gear 30, as depicted in FIG. 13C. Accordingly, the cam 31 rotates in a direction away from the support member 60, as depicted in FIG. 13A.

This rotation of the cam 31 causes the support member 60 supported by the cam 31 to rotate from a position in which the member 60 supports the second gear G2 at the first position, to another position in which the member 60 supports the second gear G2 at the second position. More specifically, the support member 60 rotates in the same direction as the first gear G1 while frictionally engaging with the first gear G1.

The rotation of the support member 60 causes the second gear G2 supported by the support member 60 to rotate from the first position to the second position. Accordingly, the second gear G2 engages the driven gear 22G, causing the conveyance member 22 to rotate.

Thereafter, further rotation of the third gear 30 causes the second spring engagement portion 34 to contact and move the first stick portion S21 of the second spring S2 upward in FIG. 13A. The second spring engagement portion 34 initially presses, at its downstream portion in the rotating direction of the third gear 30, the first stick portion S21 against the biasing force of the second spring S2. An upstream portion of the second spring engagement portion 34 in the rotating direction then contacts the first stick portion S21. At this time, the second spring S2 applies the biasing force in the rotating direction of the third gear 30 to the second spring engagement portion 34, as depicted in FIG. 14A.

Figure 14A:
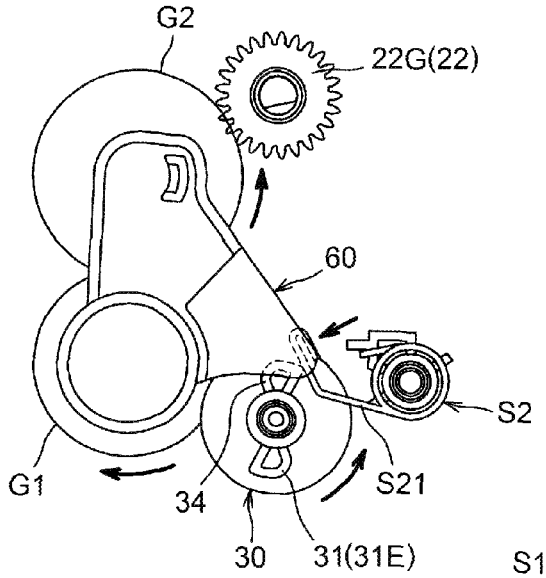
FIGS. 14A-14C depict operations of components when a first gear teeth portion is disengaged with from the first gear.
Figure 14B:
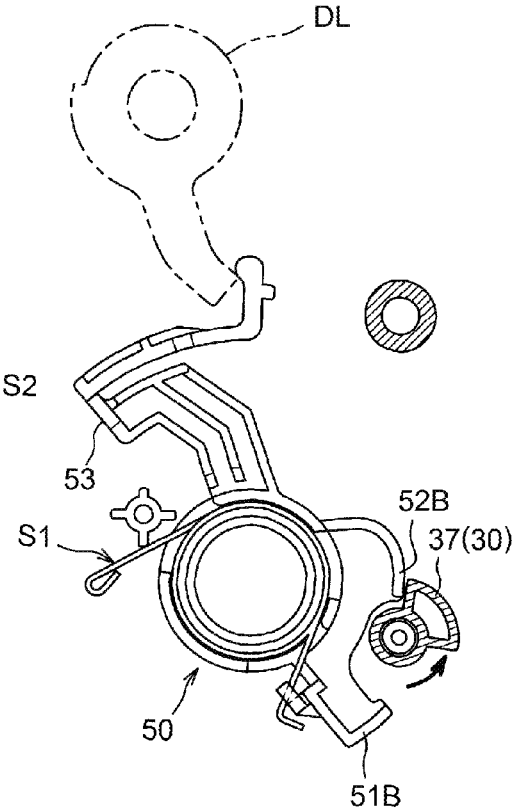
Figure 14C:
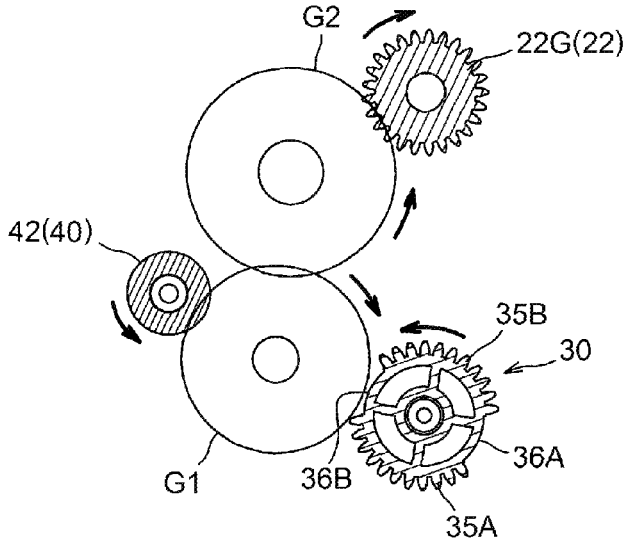

As depicted in FIG. 14C, as the first gear teeth portion 35A of the third gear 30 is disengaged from the first gear G1, the drive force from the first gear G1 is not transmitted to the third gear 30. At this time, the second spring S2 biases the second spring engagement portion 34 downstream in the rotating direction of the third gear 30 as depicted in FIG. 14A. The biasing force of the second spring S2 causes the third gear 30 to slightly rotate. This slight rotation causes the protruding portion 37 to engage the second engagement portion 52B of the lever 50, as depicted in FIG. 14B, thereby stopping the third gear 30 from rotating. The cam 31 is held apart from the support member 60, and the second gear G2 is maintained at the second position, as depicted in FIG. 14A.

To return the drive lever DL to its original position (e.g., position in FIG. 9A), in the state as depicted in FIGS. 14A-14C, the above operation described referring to FIGS. 12A-14C will be reversed. The disclosure will not repeat the detail with respect to the return of the drive lever DL. As the drive lever DL is returned to its original position (e.g., position in FIG. 9A), the lever 50 returns to the fifth position from the sixth position with the biasing force of the first spring S1. The second engagement portion 52B is disengaged from the protruding portion 37, and the cam 31 rotates similarly as described above to the position as depicted in FIG. 9A and stops at that position. The rotating cam 31 presses the support member 60 to rotate, thereby moving the second gear G2 from the second position to the first position.

The illustrative embodiment may yield effects as described below.

The movable second gear G2, which is provided in the developing cartridge 1, may be moved using drive force of the coupling CP.

The second gear G2 is configured to move between the first position and the second position with the cam 31 configured to be rotated by drive force from the coupling CP. This configuration may have lower costs than a configuration in which, for example, a large solenoid for generating large power to move a second gear is provided in a developing cartridge.

The support member 60 supports the first gear G1 and the second gear G2. The second gear G2 is configured to pivot about the first axis X1 between the first position and the second position together with the support member 60, while engaging with the first gear G1. This configuration allows the second gear G2 to move between the first position and the second position during the rotation of the first gear G1. During the rotation of the first gear G1, the second gear G2 keeps a distance with the first gear G1. According, the distance between the axes X1 and X2 is maintained. The second gear G2, which is configured to move between the first position and the second position, may selectively transmit or interrupt the drive force to the conveyance member 22. The second gear G2 is configured to pivot about the first axis X1. This configuration allows the second gear G2 either to transmit or not to transmit the drive force to the conveyance member 22 more reliably as compared with a configuration in which a gear G2 is moved in the axial direction for transmission or non-transmission of drive force.

The cam surface 31D is configured to contact the support member 60. When the toothless portion 36 faces the first gear G1, the gear 30 and the supporting member 60 do not rotate. Accordingly, the cam surface 31D may have less wear, as compared with a configuration in which, for example, a cam surface contacts a second gear.

The cam 31 and the third gear 30 are integrated into one component, which may simplify the component configuration, as compared with a configuration, for example, in which a cam and a third gear are separate.

When the gear teeth portion 35 engages the first gear G1, the cam 31 receives the drive force from the first gear G1, thereby causing the cam 31 to rotate. The rotation of the cam 31 causes the second gear G2 to move to the first position or the second position. When the toothless portion 36 faces the first gear G1, the cam 31 does not receive the drive force from the first gear G1, so that the second gear G2 may be held or maintained at the first position or the second position. In other words, the second gear G2 may be held selectively at the first position and the second position using the third gear 30 rotating in one direction.

The lever 50 is provided coaxially with the first gear G1. This configuration may provide a space for the fourth gear 40, which engages the first gear G1. Thus, the size of the developing cartridge 1 may be reduced.

The protruding portion 37 applies force to the surface 51F of the first engagement portion 51B, in a direction along the first straight line L1, which is orthogonal to the first axis X1. This configuration may prevent the force of the protruding portion 37 from causing the lever 50 to rotate.

The protruding portion 37 applies force to the surface 52F of the second engagement portion 52B, in a direction along the second straight line L2, which is orthogonal to the first axis X1. This configuration may prevent the force of the protruding portion 37 from causing the lever 50 to rotate.

The third gear 30, which is disengaged from the lever 50, rotates with the biasing force of the second spring S2. This configuration enables the gear teeth portion 35 to engage the first gear G1 reliably.

The cam 31 including the first spring engagement portion 31E has, for example, two functions, e.g., to rotate the second gear G2; and to allow the second spring S2 to engage therewith.

The second portion 31B and the third portion 31C are disposed at end portions of the first portion 31A including the cam surface 31D with respect to the rotating direction of the third gear 30. Each of the second portion 31B and the third portion 31C extends toward the third axis X3. The second portion 31B and the third portion 31C may reinforce the cam surface 31D.

The third gear 30 includes the first spring engagement portion 31E and the second spring engagement portion 34 spaced from the first spring engagement portion 31E in the rotating direction. The second spring S2 may bias either the first spring engagement portion 31E or the second spring engagement portion 34 if the third gear 30 changes its orientation.

The second spring engagement portion 34 includes the fourth portion 34A, the fifth portion 34B, and the sixth portion 34C. Each of the fifth portion 34B and the sixth portion 34C extends toward the third axis X3. This configuration may increase rigidity of the second spring engagement portion 34.

The cam 31 has a longer length than the second spring engagement portion 34 with respect to the axial direction. This configuration allows the support member 60 to be located on one side of the second spring engagement portion 34 with respect to the axial direction. The support member 60 may contact the cam surface 31D of the cam 31 without contacting the second spring engagement portion 34.

The distance from the receiving portion 53D to the first axis X1 is longer than the distance from the first engagement portion 51B to the first axis X1. This configuration enables the first engagement portion 51B to pivot, by leverage, with small force applied to the receiving portion 53D.

The distance from the receiving portion 53D to the first axis X1 is longer than the distance from the second engagement portion 52B to the first axis X1. This configuration enables the second engagement portion 52B to pivot, by leverage, with small force applied to the receiving portion 53D.

The first gear G1 supports one end portion of the support member 60. This structure may reduce the size of the support member 60, as compared with a configuration in which, for example, a first gear supports a central portion of a support member.

One end portion of the support member 60 is located inside an addendum circle of the gear teeth G11 of the first gear G1. As compared with a configuration in which, for example, one end portion of a support member is located outside one end portion of an addendum circle of a gear teeth of a first gear, interference between the one end portion of the support member 60 and other components proximate to the first gear G1 may be prevented or reduced.

The lever 50 is located between the first gear G1 and the casing 11. This configuration may allow other components (e.g., the large-diameter gear 41 of the fourth gear 40) to be located on or to a side of the first gear G1 opposite to the casing 11.

The lever 50 is located between the casing 11 and the large-diameter gear 41. Such arrangement may effectively use a space between the casing 11 and the large-diameter gear 41 and reduce the size of the developing cartridge 1.

While has aspects have been described in detail referring to the specific embodiment thereof, this is merely an example, and various changes, arrangements and modifications may be applied therein without departing from the spirit and scope of the disclosure. Like reference numerals denote like corresponding parts and detailed description thereof with respect to the following modifications will be omitted herein.

Figure 15A:
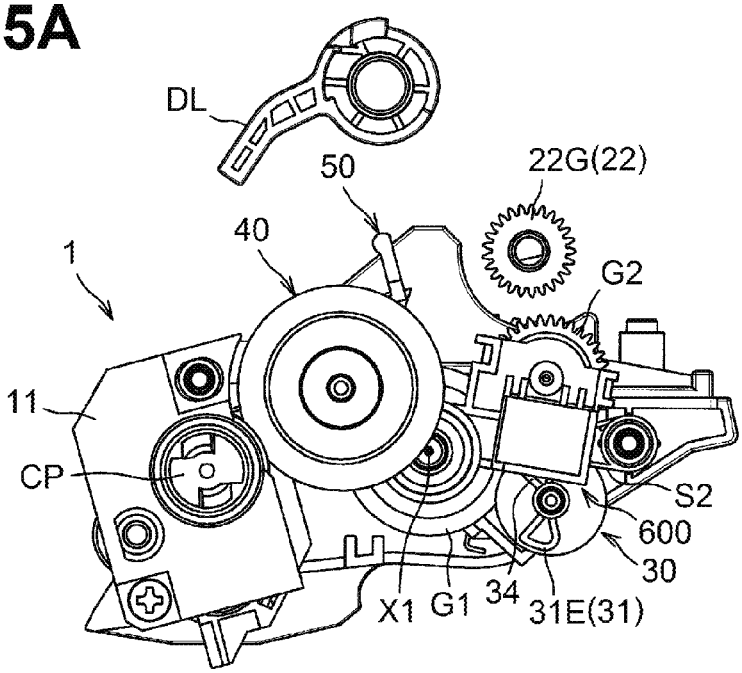
FIGS. 15A-15C depict a developing cartridge according to a first modification, wherein the second gear is at the second position.
Figure 15B:
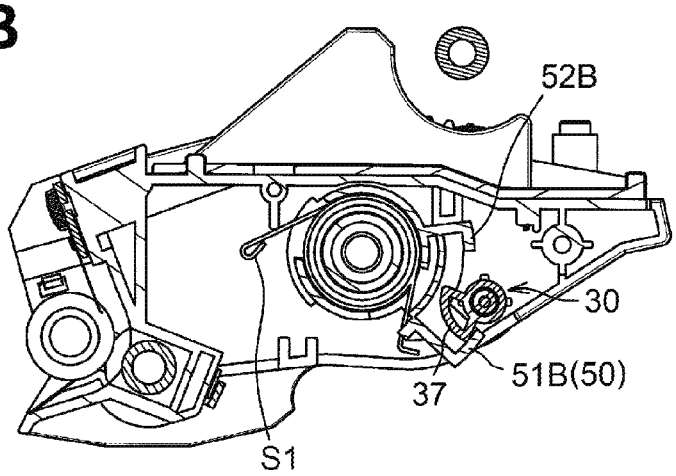
Figure 15C:
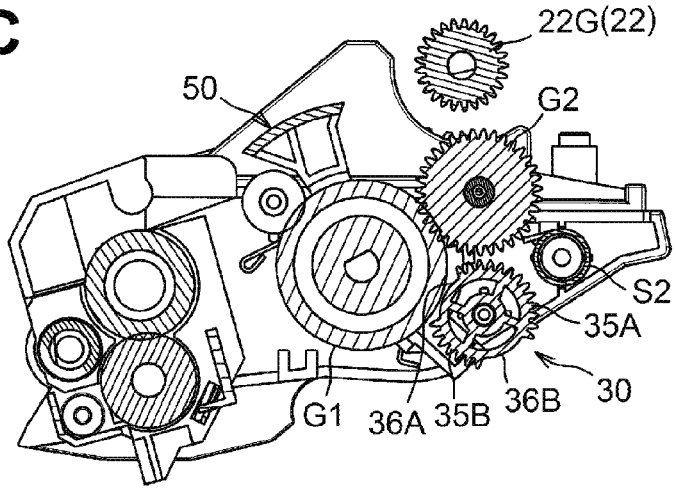
Figure 16A:
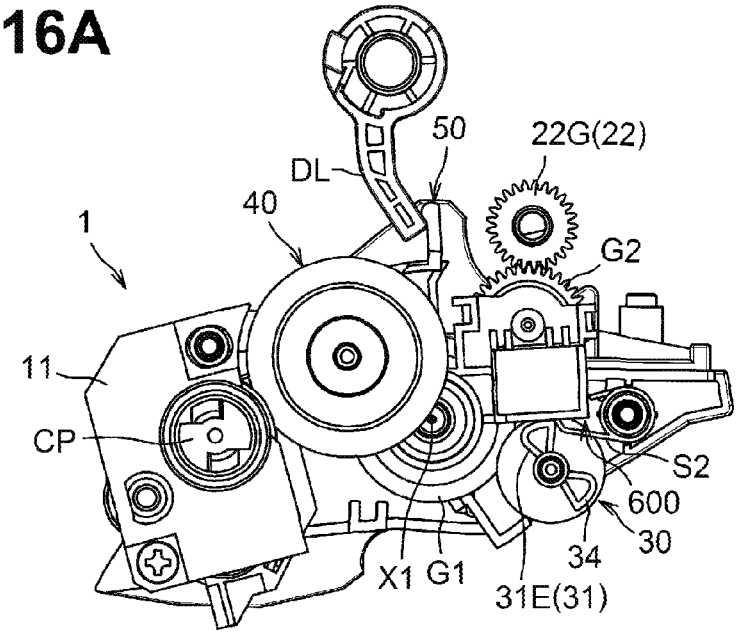
FIGS. 16A-16C depict the developing cartridge according to the first modification, wherein the second gear is at the first position.
Figure 16B:
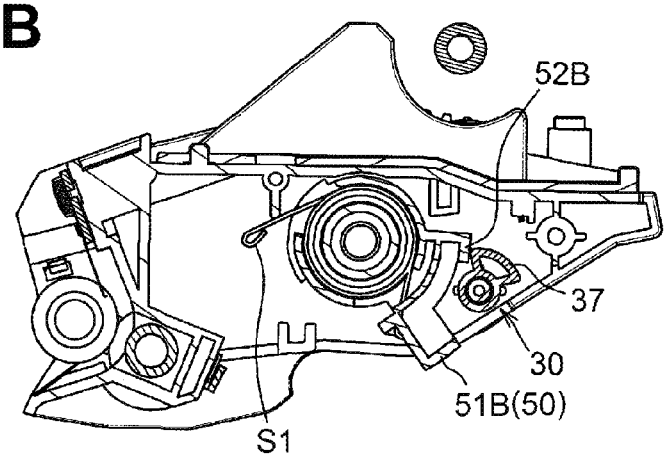
Figure 16C:
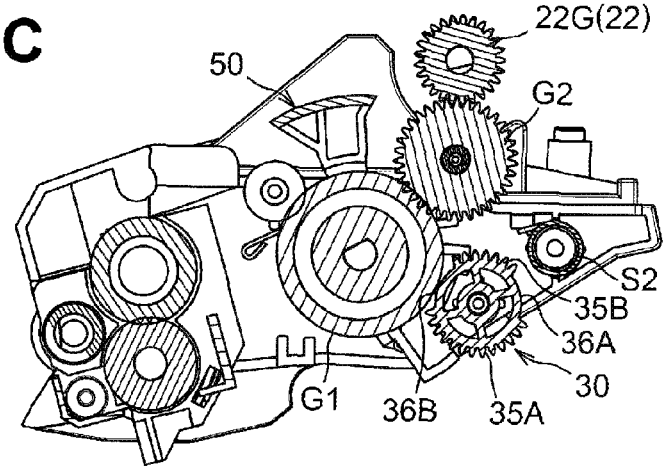

In the above-described illustrative embodiment, when the second gear G2 is at the first position where the second gear G2 is disengaged from the driven gear 22G, the cam 31 is in contact with the support member 60. When the second gear G2 is at the second position where the second gear G2 is engaged with the driven gear 22G, the cam 31 does not contact the support member 60. The disclosure is not limited to this configuration. For example, as depicted in FIGS. 15A-15C, the cam 31 may be configured to be separated from a support member 600 when the second gear G2 is disengaged from the driven gear 22G. As depicted in FIGS. 16A-16C, the cam 31 may be configured to contact the support member 600 when the second gear G2 is engaged with the driven gear 22G. Although the support members 60 and 600 have different shapes, the support member 600 according to this modification is pivotable about the first axis X1 and rotatably supports the first and second gears G1 and G2, similar to the support member 60. The detailed description of the support member 600 is therefore omitted.

Other components according to the modification may also have some difference from corresponding components of the above-described illustrative embodiment. However, configurations to achieve functions of those components are basically the same as the illustrative embodiment. Detailed description of the components with respect to modifications is also omitted herein.

Pivoting of the drive lever DL from the position in FIG. 15A to the position in FIG. 16A causes the lever 50 to rotate from the fifth position to the sixth position, thereby causing the first engagement portion 51B to disengage from the protruding portion 37. This causes the third gear 30 to rotate with the biasing force of the second spring S2, resulting in engagement of the first gear teeth portion 35A with the first gear G1.

While the first gear teeth portion 35A is engaged with the first gear G1, the third gear 30 rotates counterclockwise in FIGS. 15A-16C with drive force from the first gear G1, thereby rotating the cam 31 to move to a higher position (in FIG. 16A) from a lower position (in FIG. 15A). As the cam 31 contacts the support member 600, the support member 600 is raised by the cam 31 and moves together with the second gear G2 such that the second gear G2 is located at the first position.

When the second toothless portion 36B faces the first gear G1 as depicted in FIG. 16C, the drive force is not transmitted from the first gear G1 to the third gear G3. Thereafter, the second spring S2 biases the first spring engagement portion 31E, thereby causing the protruding portion 37 to engage the second engagement portion 52B, as depicted in FIG. 16B. The third gear 30 is thus prevented from rotating and is, instead, maintained at a position where the cam 31 supports the support member 600.

Pivoting of the drive lever DL from the position in FIG. 16A to the position in Fig. FIG. 15A causes the lever 50 to rotate from the sixth position to the fifth position with the biasing force of the first spring S1, thereby disengaging the second engagement portion 52B from the protruding portion 37. This allows the cam 31 to rotate in a direction away from the support member 600. Such rotation of the cam 31 causes the support member 600 supported by the cam 31 to be pivotally lowered. As depicted in FIG. 15A, the second gear G2 is thus moved to the second position where the support member 600 is maintained at that position by a holding member (not depicted).

As the first toothless portion 36A faces the first gear G1 as depicted in FIG. 15C, transmission of the drive force from the first gear G1 to the third gear G3 is interrupted. The second spring S2 then biases the second spring engagement portion 34 to bring the protruding portion 37 into engagement with the first engagement portion 51B, as depicted in FIG. 15B. This prevents the third gear 30 from rotating, thereby holding the cam 31 at a position away from the support member 600. In short, the cam 31 is separated from the support member 600 when the second gear G2 is at the second position together with the support member 600.

Figure 17A:
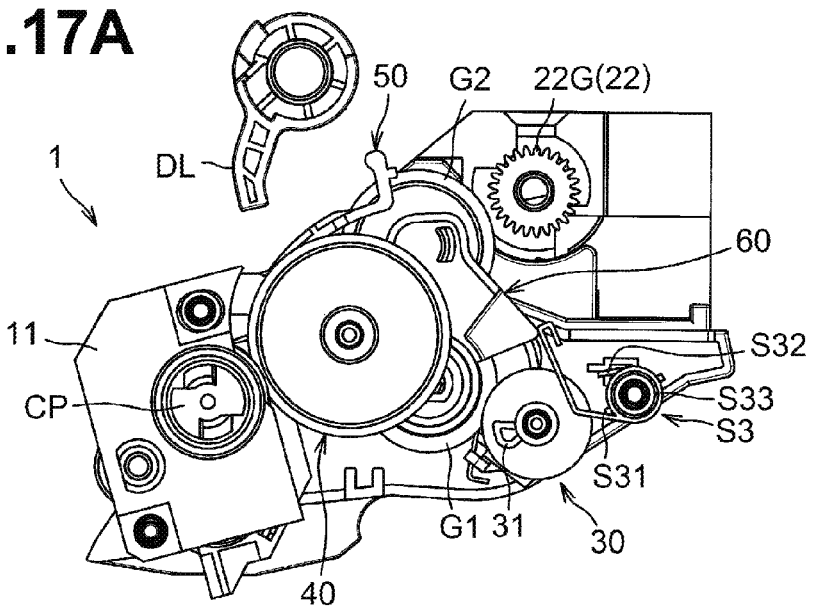
FIGS. 17A-17C depict a developing cartridge according to a second modification, wherein the second gear is at the first position.
Figure 17B:
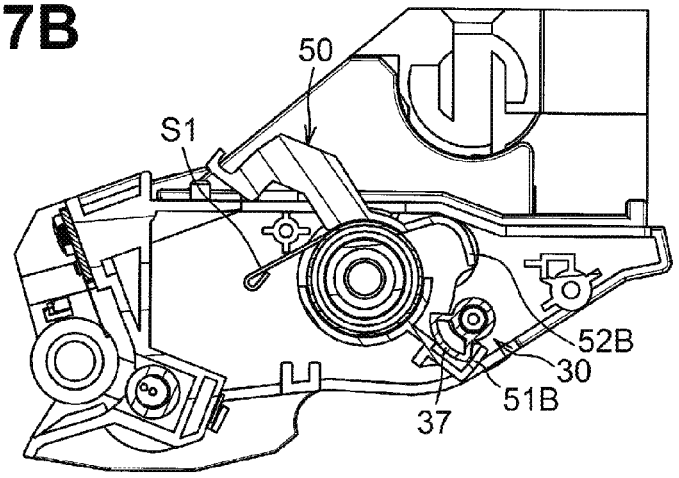
Figure 17C:
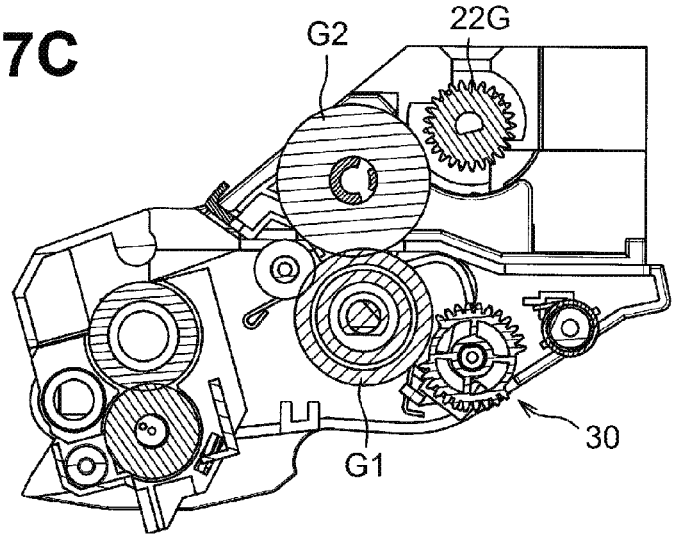
Figure 18A:
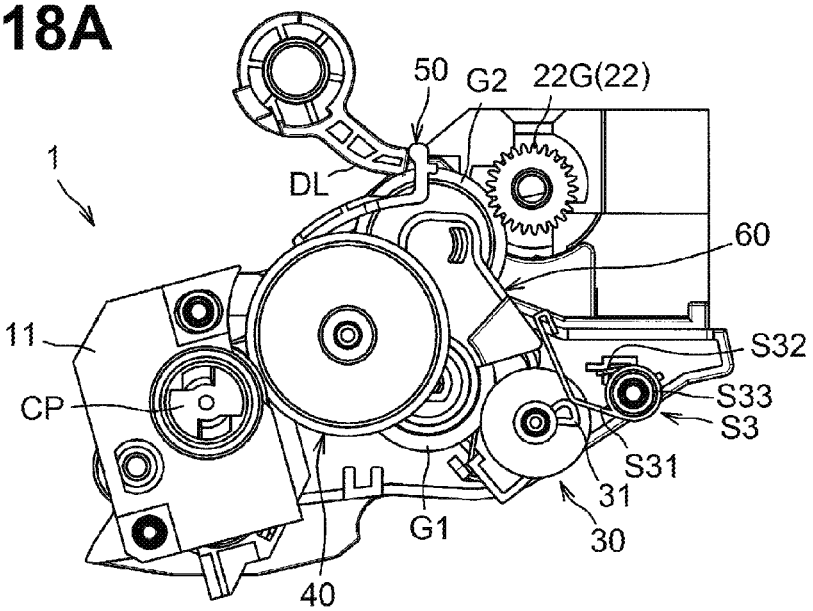
FIGS. 18A-18C depict the developing cartridge according to the second modification, wherein the second gear is at the second position.
Figure 18B:
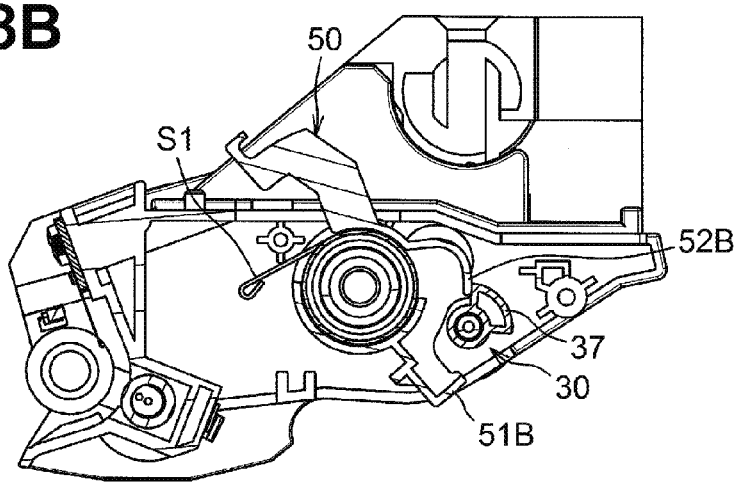
Figure 18C:
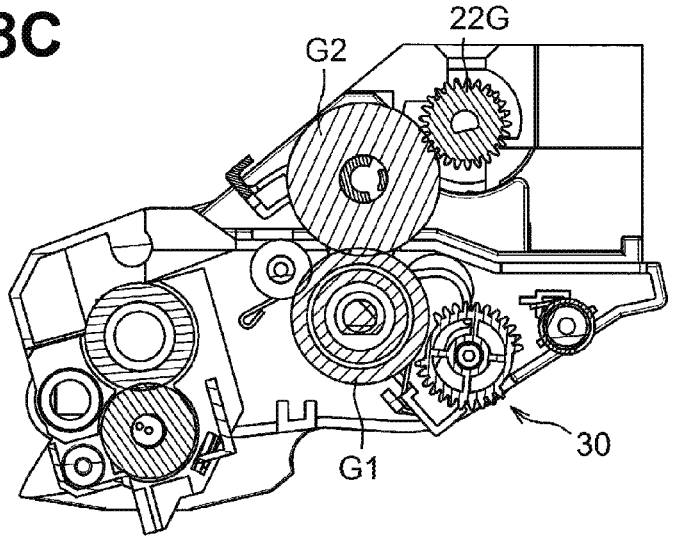

In the illustrative embodiment, the cam 31 is configured to contact and be separated from the support member 60 to move the second gear G2 between the first position and the second position. However, the disclosure is not limited thereto. For example, as depicted in FIG. 17A, a third spring S3 may be used to hold the second gear G2 at the first position together with the support member 60. As depicted in FIG. 18A, the rotating cam 31 of the third gear 30 may contact the third spring S3 to release the support for the support member 60. This configuration allows the second gear G2 to move to the second position together with the support member 60.

More specifically, the third gear 30 according this modification does not include the second spring engagement portion 34, and the third spring S3 is provided in lieu of the second spring S2 of the illustrative embodiment. The third spring S3 may be, for example, a torsion spring. The third spring S3 includes a coiled portion S33, a first stick portion S31 extending outward in a radial direction of the coiled portion S33 from an end portion of the coiled portion S33, and second stick portion S32 extending outward in the radial direction of the coiled portion S33 from an opposite end portion of the coiled portion S33. The coiled portion S33 is supported by the casing 11. The second stick portion S32 is engaged with the casing 11. The first stick portion S31 contacts the support member 60 supporting the second gear G2 at the first position. A portion of the first stick portion S31 is located within a rotating path of the cam 31.

Pivoting of the drive lever DL from the position in FIG. 17A to the position in FIG. 18A causes the lever 50 to rotate from the fifth position to the sixth position, thereby disengaging the first engagement portion 51B from the protruding portion 37. This allows the third gear 30 and the cam 31 to rotate counterclockwise in FIGS. 17A-18C.

As depicted in FIG. 18A, the rotating cam 31 may contact the first stick portion S31 of the third spring S3, to press the first stick portion S31. This pressing causes the first stick portion S31 to pivot clockwise in FIG. 18A, resulting in nonsupport of the support member 60 with the first stick portion S31. This allows the second gear G2 to move from the first position to the second position together with the support member 60.

Pivoting of the drive lever DL from the position in FIG. 18A to the position in FIG. 17A causes the lever 50 rotate to from the sixth position to the fifth position, thereby disengaging the second engagement portion 52B from the protruding portion 37. This allows the third gear 30 to rotate such that the cam 31 moves away from the first stick portion S31.

Accordingly, the first stick portion S31 moves, due to its biasing force, toward the position as depicted in FIG. 17A. During the pivoting of the drive lever DL, the first stick portion S31 contacts the support member 60 and presses the support member 60 counterclockwise in FIG. 17A, which causes the second gear G2 to move to the first position together with the support member 60.

Aspects described herein is described in reference to the developing cartridge 1 configured to be attached and detached relative to the developer cartridge 2. However, the disclosure is not limited thereto. For example, a developing cartridge and a developer cartridge may be integrated into one unit. More specifically, the developing cartridge may include a first container portion, a second containing portion, a conveyance member, and a driven gear. The first container portion may be configured to contain developer. The second containing portion may be configured to receive the developer from the first container portion. The conveyance member may be disposed in the first container portion and may be configured to convey the developer in the first container portion toward the second containing portion. The driven gear may be provided to rotate the conveyance member. In this configuration, the second gear may be configured to engage the driven gear when the second gear is at the second position.

Figure 21:
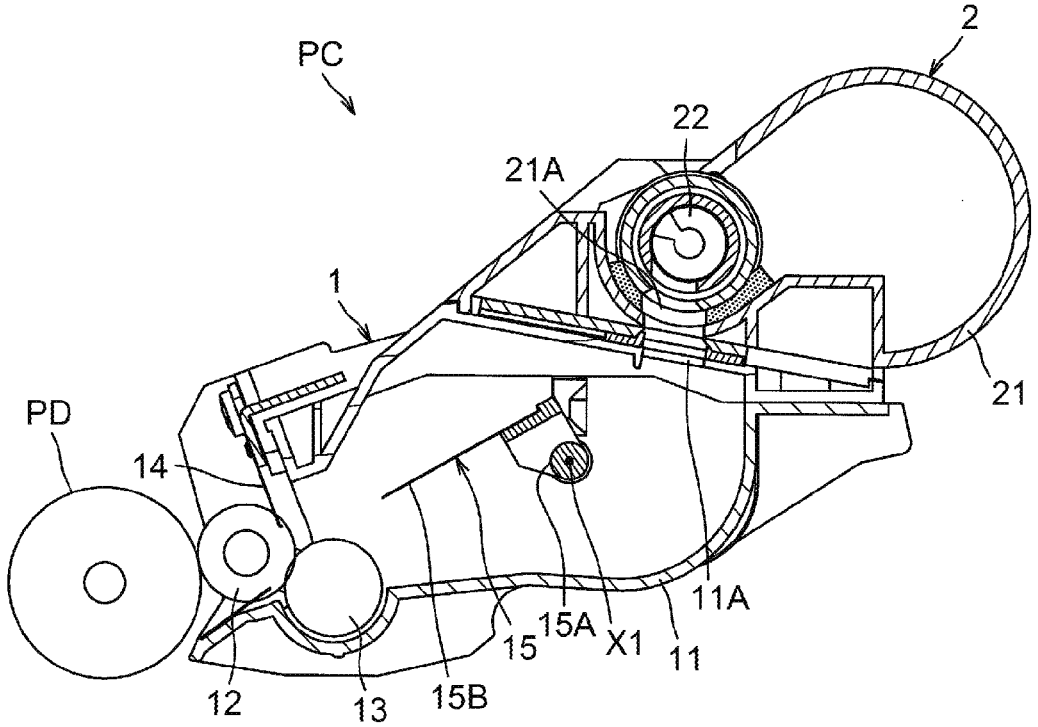
FIG. 21 depicts a developing cartridge according to a third modification according to one or more aspects of the disclosure.

As depicted in FIG. 21, the developing cartridge 1 may further include a photosensitive drum PD configured to receive developer from the developing roller 12.

Figure 19A:
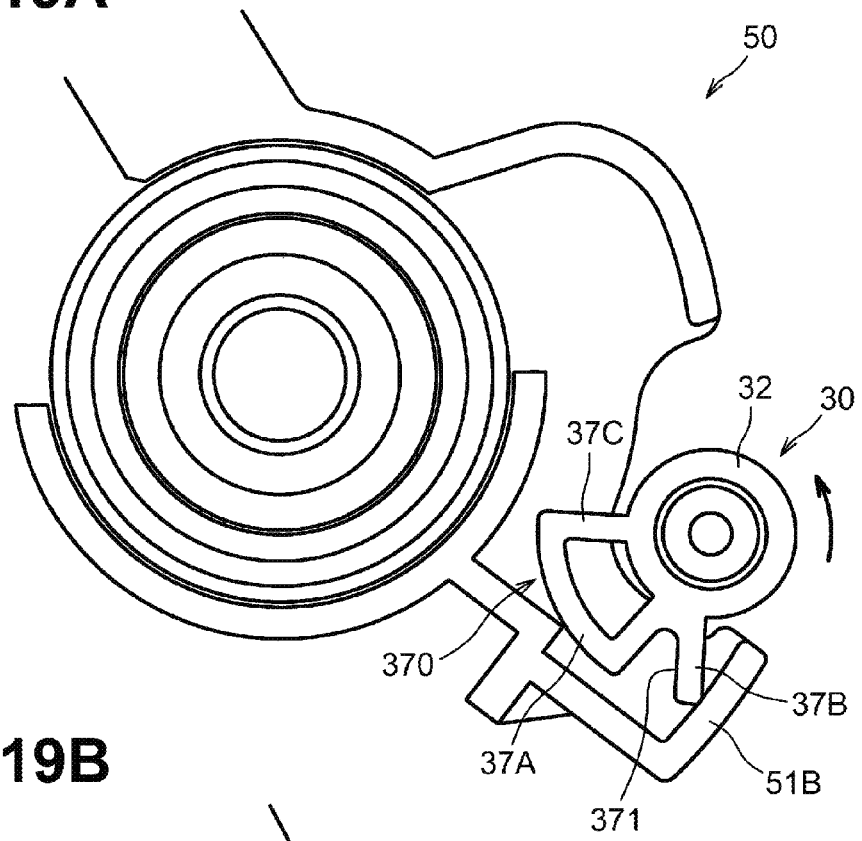
FIGS. 19A and 19B depict a modified protruding portion according to one or more aspects of the disclosure.
Figure 19B:
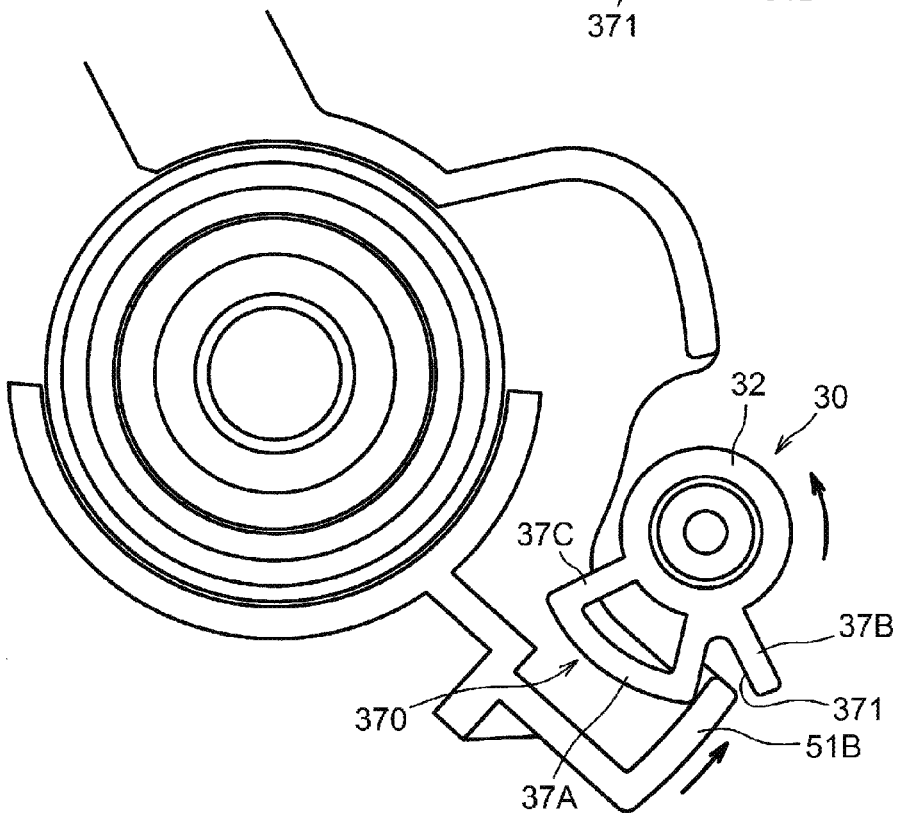

The shape of the protruding portion 37 is not limited to a specific example in the illustrative embodiment. For example, a protruding portion may have a shape as depicted in FIGS. 19A and 19B. More specifically, as depicted in FIG. 19A, a protruding portion 370 may include a seventh portion 37A, an eighth portion 37B, and a ninth portion 37C, similar to the illustrative embodiment. A portion of an outer peripheral surface of the seventh portion 37A may be cut out to define a recessed portion 371. The recessed portion 371 may be sized to engage with the first engagement portion 51B. A distance from the recessed portion 371 to the ninth portion 37C, which is disposed upstream of the recessed portion 371 in the rotating direction of the third gear 30, is greater than a distance from the recessed portion 371 to the eighth portion 37B, which is disposed downstream of the recessed portion 371 in the rotating direction of the third gear 30.

A new or unused developing cartridge 1 may receive an external force causing the lever 50 to slightly rotate clockwise in FIG. 19A. The lever 50, which is slightly rotated, may move to return to its previous or original position due to the biasing force of the first spring S1. The clockwise rotation of the lever 50 may cause the first engagement portion 51B to disengage from the eighth portion 37B of the protruding portion 370. The third gear 30 may be rotated counterclockwise by the biasing force of the second spring S2. As the lever 50 rotates to return to the original position by the biasing force of the first spring S1, the first engagement portion 51B may enter the recessed portion 371. This configuration may prevent an unintentional rotation of the third gear 30.

Figure 20:
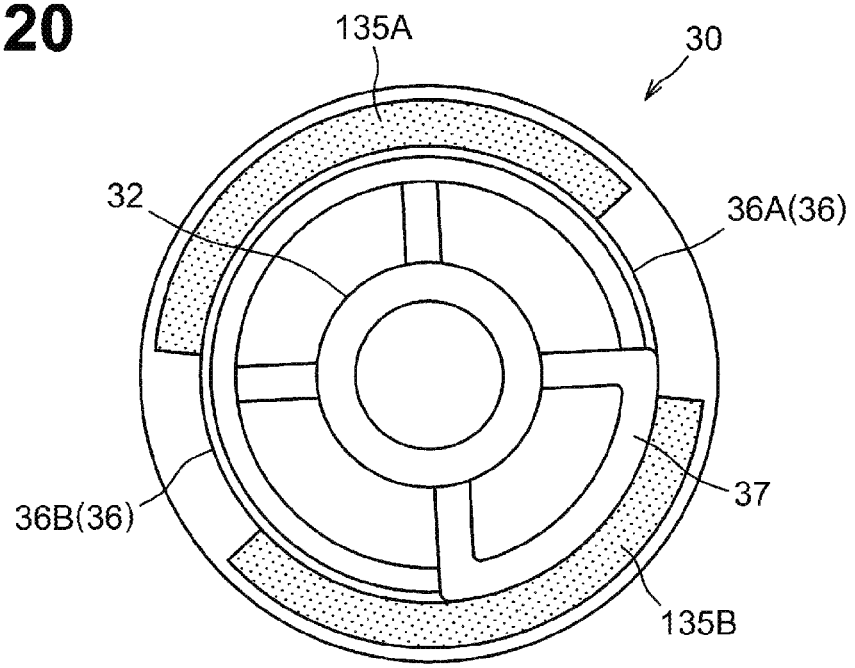
FIG. 20 depicts modified gear teeth portions according to one or more aspects of the disclosure.

In the illustrative embodiment, each of the gear teeth portions 35A and 35B includes a plurality of gear teeth. However, the disclosure is not limited thereto. For example, as depicted in FIG. 20, the third gear 30 may include a first gear teeth portion 135A and a second gear teeth portion 135B, each formed of rubber into a plate shape along a circumferential direction of the gear 30. The gear teeth portions 135A and 135B may frictionally engage the first gear G1. Other gears may include rubber gear teeth similarly.

In the illustrative embodiment, the third gear 30 directly engages the first gear G1. However, the disclosure is not limited thereto. For example, an idle gear may be disposed between the first gear G1 and the third gear 30. The third gear 30 may rotate when engaged with the idle gear. This configuration may yield effects similar to those of the illustrative embodiment.

What is claimed is:

1. A developing cartridge, comprising:

a developing roller configured to rotate about an axis extending in an axial direction;

a first gear configured to rotate about a first axis extending in the axial direction, the first gear configured to be rotated by a drive force;

a second gear configured to rotate about a second axis extending in the axial direction, the second gear configured to be driven by the first gear to pivot about the first axis of the first gear between a first position and a second position;

a third gear configured to be rotated by the first gear; and a cam configured to rotate about a third axis extending in the axial direction with rotation of the third gear, wherein the third gear includes:

a first toothless portion configured to, when facing the first gear, interrupt transmission of the drive force from the first gear; and a gear teeth portion configured to receive the drive force from the first gear by engaging gear teeth of the first gear, and wherein the cam is configured to rotate about the third axis to:

a first cam position, wherein the rotation of the cam to the first cam position moves the second gear to the first position; and a second cam position, wherein the second gear is configured to move to the second position when the cam rotates to the second cam position, wherein the second gear is closer to the third axis at the second position than when at the first position.

2. The developing cartridge according to claim 1, wherein the third gear further comprises:

a second toothless portion disposed at a position different from the first toothless portion with respect to a rotating direction of the third gear, the second toothless portion configured to, when facing the first gear, interrupt transmission of the drive force from the first gear, wherein the gear teeth portion is disposed between the first toothless portion and the second toothless portion in the rotating direction of the third gear, wherein the second toothless portion faces the first gear when the second gear is in the second position, and wherein the first toothless portion faces the first gear when the second gear is in the first position.

3. The developing cartridge according to claim 1, wherein at the second position, the second gear is engaged with a driven gear; and at the first position, the second gear is disengaged from the driven gear.

4. The developing cartridge according to claim 3, wherein the developing cartridge is configured to removably receive a developer cartridge containing developer therein, the developer cartridge including the driven gear.

5. The developing cartridge according to claim 4, wherein the developer cartridge further includes a conveyance member configured to rotate about an axis extending along the axial direction, the conveyance member configured to convey the developer in the developer cartridge along the axial direction to the developing cartridge; and the driven gear is mounted on an end of the conveyance member.

6. The developing cartridge according to claim 3, further comprising a support member rotatably supporting the first gear and the second gear, the support member configured to pivot about the first axis together with the second gear.

7. The developing cartridge according to claim 6, wherein when the second gear is at the first position, the cam is in contact with the support member, and when the second gear is at the second position, the cam does not contact the support member.

8. The developing cartridge according to claim 1, wherein at the first position, the second gear is engaged with a driven gear; and at the second position, the second gear is disengaged from the driven gear.

9. The developing cartridge according to claim 8, wherein the third gear is configured to rotate about the third axis.

10. The developing cartridge according to claim 9, wherein the third gear further comprises:

a second toothless portion disposed at a position different from the first toothless portion with respect to a rotating direction of the third gear, the second toothless portion configured to, when facing the first gear, interrupt transmission of the drive force from the first gear, wherein the gear teeth portion is disposed between the first toothless portion and the second toothless portion in the rotating direction of the third gear, wherein the second toothless portion faces the first gear when the second gear is in the second position, wherein the first toothless portion faces the first gear when the second gear is in the first position, and wherein the third gear is configured to rotationally move between a third position in which the gear teeth portion engages the first gear, and a fourth position in which one of the first toothless portion and the second toothless portion faces the first gear.

11. The developing cartridge according to claim 10, further comprising a lever configured to engage the third gear, the lever configured to rotate about an axis extending in the axial direction between a fifth position and a sixth position;

at the fifth position, the lever is engaged with the third gear and the first toothless portion faces the first gear; and at the sixth position, the lever is engaged with the third gear and the second toothless portion faces the first gear.

12. The developing cartridge according to claim 11, wherein the lever is configured to rotate about the first axis.

13. The developing cartridge according to claim 11, wherein the third gear includes:

a rotation shaft having an axis corresponding to the third axis; and a protruding portion protruding from a portion of a peripheral surface of the rotation shaft, the protruding portion configured to engage the lever when the third gear is at the fourth position, wherein the protruding portion is disposed at a position along the rotation shaft different from a position of the gear teeth portion along the rotation shaft.

14. The developing cartridge according to claim 13, wherein the lever includes:

a main body having a cylindrical shape with a center thereof corresponding to the first axis; and a first arm extending from the main body toward the third gear and configured to rotate together with the main body, the first arm including a first engagement portion configured to engage the protruding portion, the first engagement portion being provided at an end portion of the first arm opposite to the main body, and wherein when the protruding portion is engaged with the first engagement portion, the second gear is at the first position.

15. The developing cartridge according to claim 14, wherein when the lever is at the fifth position, the first engagement portion is disposed within a rotating path of the protruding portion to engage the protruding portion, and when the lever is at the sixth position, the first engagement portion is disposed outside of the rotating path of the protruding portion.

16. The developing cartridge according to claim 15, wherein the lever includes a second arm extending from the main body toward the third gear, the second arm configured to rotate together with the main body, the second arm including a second engagement portion configured to engage the protruding portion, the second engagement portion being provided at an end portion of the second arm opposite to the main body, and wherein when the protruding portion is engaged with the second engagement portion, the second gear is at the second position.

17. The developing cartridge according to claim 16, wherein when the lever is at the sixth position, the second engagement portion is disposed within the rotating path of the protruding portion to engage the protruding portion, and when the lever is at the fifth position, the second engagement portion is disposed outside of the rotating path of the protruding portion.

18. The developing cartridge according to claim 16, wherein further comprising a spring configured to, when the first engagement portion is engaged with the protruding portion, bias the third gear such that the protruding portion approaches the first engagement portion in the rotation direction of the third gear.

19. The developing cartridge according to claim 18, wherein the third gear includes:

a disk portion having a circular shape with a center thereof corresponding to the third axis; and wherein the cam protrudes from the disk portion in the axial direction, the cam including a first spring engagement portion configured to engage the spring.

20. The developing cartridge according to claim 19, wherein the third gear includes a second spring engagement portion configured to engage the spring, the second spring engagement portion protruding from the disk portion in the axial direction and being spaced from the first spring engagement portion in the rotating direction of the third gear.

21. The developing cartridge according to claim 20, wherein when the protruding portion is engaged with the first engagement portion, the spring contacts the first spring engagement portion.

22. The developing cartridge according to claim 21, wherein when the protruding portion is engaged with the second engagement portion, the spring contacts the second spring engagement portion.

23. The developing cartridge according to claim 16, wherein the lever further includes a third arm extending from the main body toward a direction away from the first arm, and configured to rotate together with the main body, the third arm including a receiving portion configured to receive a force from an image forming apparatus.

24. The developing cartridge according to claim 1, further comprising a photosensitive drum.

25. A developing cartridge comprising:

a first gear having a first rotational axis;

a support member pivotable about the first rotational axis;

a second gear having a second rotational axis spaced apart from the first rotational axis, the second gear being connected to the support member at the second rotational axis; and a third gear having a third rotational axis:

a gear body;

a first toothless portion along a circumferential surface of the gear body;

a plurality of gear teeth extending radially from the circumferential surface of the gear body; and a cam extending from the gear body in an axial direction of the third rotational axis, wherein an engagement portion of the support member is disposed within a rotational path of the cam, the engagement portion being spaced apart from the first rotational axis and the second rotational axis.

26. The developing cartridge of claim 25, wherein the third gear comprises a second toothless portion, wherein the plurality of gear teeth are disposed between the first and second toothless portions in a rotational direction of the third gear.

27. The developing cartridge of claim 26, wherein, when the cam engages the engagement portion of the support member, one of the first toothless portion and the second toothless portion of the third gear faces the first gear.

28. The developing cartridge of claim 25, further comprising a biasing member configured to bias the third gear in a rotational direction.

29. The developing cartridge of claim 28, further comprising a holding member, wherein the third gear further comprises:

a biasing member engagement portion; and a protruding portion, the biasing member engagement portion being spaced apart from the protruding portion in a rotational direction of the third gear, and wherein the biasing member is configured to contact the biasing member engagement portion while the holding member contacts the protruding portion.

30. The developing cartridge of claim 29, wherein the holding member is pivotable between a first position in which the holding member is disposed within a rotational path of the protruding portion and a second position in which the holding member is not disposed within the rotational path of the protruding portion.

* * * * *